US009500434B1

(12) United States Patent
LoRocco et al.

(10) Patent No.: US 9,500,434 B1
(45) Date of Patent: Nov. 22, 2016

(54) ARROW REST WITH ADJUSTABLE SUPPORT

(71) Applicant: TruGlo, Inc., Richardson, TX (US)

(72) Inventors: Paul LoRocco, Dallas, TX (US); Anthony T. LoRocco, Richardson, TX (US); John Estridge, Garland, TX (US); Damon Lamont Coalson, Dallas, TX (US)

(73) Assignee: TruGlo, Inc., Richardson, TX (US)

( * ) Notice: Subject to any disclaimer, the term of this patent is extended or adjusted under 35 U.S.C. 154(b) by 0 days.

(21) Appl. No.: 15/138,113

(22) Filed: Apr. 25, 2016

(51) Int. Cl.
*F41B 5/22* (2006.01)
*F41B 5/14* (2006.01)

(52) U.S. Cl.
CPC ..... *F41B 5/143* (2013.01)

(58) Field of Classification Search
CPC ..... F41B 5/143
See application file for complete search history.

(56) References Cited

U.S. PATENT DOCUMENTS

| | | | | |
|---|---|---|---|---|
| 3,225,755 | A | 12/1965 | Shankland | |
| 3,504,659 | A | 4/1970 | Babington | |
| 3,674,002 | A | 7/1972 | Diamond, Sr. | |
| 3,890,951 | A | 6/1975 | Jennings et al. | |
| 4,552,121 | A | 11/1985 | Treaster | |
| 4,593,673 | A | 6/1986 | Kees | |
| 4,759,337 | A | 7/1988 | Suski | |
| 4,848,306 | A | 7/1989 | Treaster | |
| 4,858,589 | A | 8/1989 | Chang | |
| 4,917,072 | A | 4/1990 | Chang | |
| 5,462,041 | A | 10/1995 | Solecki | |
| RE38,096 | E | 4/2003 | Branthwaite et al. | |
| 6,725,851 | B1 | 4/2004 | Graf | |
| 6,742,510 | B2 | 6/2004 | Troncoso, Jr. | |
| 6,978,775 | B2 | 12/2005 | Graf | |
| 6,994,080 | B1 | 2/2006 | Yoder | |
| 7,827,979 | B2 | 11/2010 | Rager | |
| 7,913,678 | B2 | 3/2011 | Hudkins | |
| 8,875,687 | B1 * | 11/2014 | Huang | F41B 5/143 124/24.1 |
| 9,243,862 | B1 * | 1/2016 | Webb | F41B 5/143 |

* cited by examiner

*Primary Examiner* — John Ricci
(74) *Attorney, Agent, or Firm* — Alvin R. Wirthlin

(57) ABSTRACT

An arrow rest assembly for connection to an archery bow includes a first support frame having a first axis and a first support assembly having a first support member extending from the first support frame towards the axis. The first support member is adjustable toward and away from the first axis such that an arrow shaft axis can be aligned with respect to the first axis of the first support frame. A second support assembly has a second support frame connected to the first support frame with at least one second support member extending from the second support frame to form a central opening for receiving the arrow shaft. The at least one second support member extends around at least a portion of the second support frame to capture the arrow shaft within the central opening to thereby prevent inadvertent dislodgement of the arrow shaft from the arrow rest.

23 Claims, 17 Drawing Sheets

ARROW REST WITH ADJUSTABLE SUPPORT

BACKGROUND OF THE INVENTION

This invention relates generally to accessories for archery bows, and more particularly to an arrow rest that captures an arrow shaft in a centered position during use, and which deflects during release of the arrow from an archery bow.

In hunting, 3D archery, and field archery, accuracy is of paramount importance. The presence of the arrow rest plays a very significant role in achieving accuracy in shooting. There are many factors in the operation of a compound bow which may be affected by the presence of the arrow rest. For example, even prior to launching or releasing the arrow from the archery bow, the arrow rest may fail to properly capture the arrow shaft during loading as well as during movement of the archer or while pulling back the arrow to a shooting position, and, consequently, the arrow may move around within the boundaries of the arrow rest or may even fall out of the arrow rest and disengage from the bowstring, causing damage to the archery equipment, possible injury to the archer and others, as well as creating noise that may scare off game. The failure to properly capture the arrow may also lead to inaccurate shooting as the arrow flies off the rest at an improper angle.

Moreover, prior art rests that may properly capture the arrow shaft may not be adaptable to different arrow sizes or diameters. The most popular diameters for arrows range from about 0.23 to about 0.37 inch. Thus, an arrow rest that may properly capture an arrow shaft having a diameter of 0.23 inch may not be able to accommodate a larger diameter arrow of 0.37 inch, for example. Conversely, an arrow rest that may properly capture a 0.37-inch diameter shaft may be too loose for a 0.23-inch diameter shaft.

As shown in FIG. 1 for example, a prior art full capture arrow rest 1 includes an outer circular support frame 2 with a plurality of support bristles 3 that extend radially inwardly from the support frame 2 to form a central opening 4 for receiving the shaft 5 of an arrow 9. As shown, the shaft 5 is larger in diameter than the opening 4, resulting in the ends of the bristles 3 applying unnecessary amount of radial pressure to the arrow shaft, causing undesirable drag, premature wear of the support bristles, and uneven seating of the arrow shaft within the opening, thereby leading to inaccurate and inconsistent shots. Moreover, the relatively stiff nature of the bristles may not allow for temporary deformation of the arrow shaft when the arrow is initially shot and before it clears the arrow rest. This inflexibility may further lead to inaccuracies and inconsistencies in shooting and may also damage the arrow rest.

Likewise, in FIG. 1B for example, when the diameter of the arrow shaft 5 is too small for the central opening 4 of the prior art full capture arrow rest 1, the arrow shaft 5 will normally be supported on a portion of the bristles 3 in an off-centered position as shown. This may result in the arrow shaft angling slightly downward or otherwise off-center, thereby creating difficulty in achieving accuracy and consistency each time the arrow is fired. In addition, premature wear of the support bristles may occur over time, leading to an even further off-center position of the arrow shaft and its unintended consequences.

Moreover, because all arrows are sized to bend slightly under the instantaneous load applied to the shaft upon release, the trajectory of the arrow can be altered by its deflection against the rest, especially if the rest is rigid or fits too tightly against the arrow shaft, as discussed above.

Likewise, during release of the arrow, the archer may subject the bow to some inadvertent horizontal or vertical movement that is transferred to the rest and thence to the arrow, thereby causing the trajectory of the arrow to be altered. Finally, noise generated as the arrow shaft slides across the arrow rest can be sufficient to frighten game during hunting.

It would therefore be desirous to provide an arrow rest that overcomes one or more of the above-mentioned disadvantages.

BRIEF SUMMARY OF THE INVENTION

In accordance with one aspect of the invention, an arrow rest assembly for connection to an archery bow and for supporting and capturing an arrow having an arrow shaft and vanes extending therefrom includes at least one support frame defining a space for receiving an arrow shaft, a post extending into the space for supporting the arrow shaft, and a plurality of support members connected to the at least one support frame and extending into the space. The plurality of support members are arranged to surround the arrow shaft sufficiently to define an opening having a predetermined size larger than the arrow shaft for capturing the arrow shaft therein and directing movement of the arrow shaft towards the post. The plurality of support members are spaced from the arrow shaft when the arrow shaft is supported by the post. The support members are arranged with respect to the at least one support frame such that at least one of the vanes of the arrow is adapted to pass through adjacent support members when the arrow is launched from the archery bow.

In accordance with another aspect of the invention, an arrow rest assembly for connection to an archery bow includes a first support frame having a first axis and a first support assembly having a first support member extending from the first support frame towards the axis. The first support member is adjustable toward and away from the first axis such that an arrow shaft axis can be aligned with respect to the first axis of the first support frame. A second support assembly has a second support frame connected to the first support frame with at least one second support member extending from the second support frame to form a central opening for receiving the arrow shaft. The at least one second support member extends around at least a portion of the second support frame to capture the arrow shaft within the central opening to thereby prevent inadvertent dislodgement of the arrow shaft from the arrow rest.

Other aspects of the invention will become apparent upon review of the specification, including the detailed description of the invention, the appended claims, and the accompanying drawings.

BRIEF DESCRIPTION OF THE DRAWINGS

The foregoing summary as well as the following detailed description of the preferred embodiments of the present invention will be best understood when considered in conjunction with the accompanying drawings, wherein like designations denote like elements throughout the drawings, and wherein.

It is noted that the drawings are intended to depict only typical or exemplary embodiments of the invention and therefore should not be considered as limiting the scope thereof. It is further noted that the drawings are not necessarily to scale. The invention will now be described in greater detail with reference to the accompanying drawings.

DETAILED DESCRIPTION OF THE INVENTION

Figure 2:
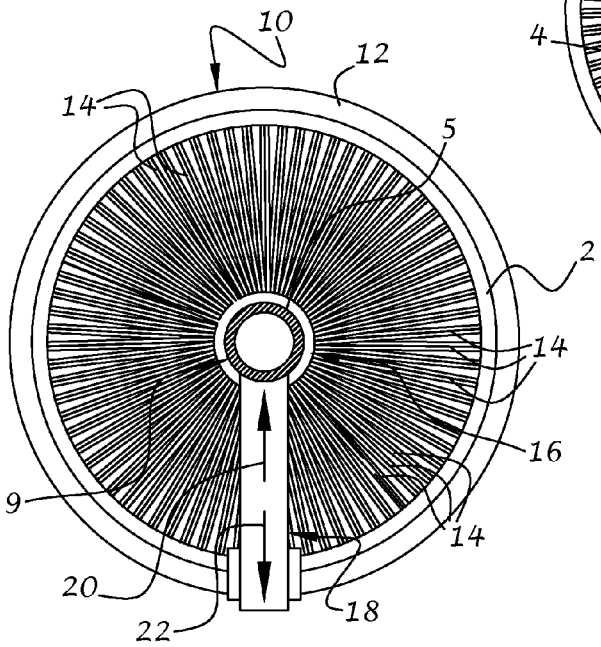
FIG. 2 is a rear elevational diagrammatic view of an arrow rest with an adjustable arrow shaft support in accordance with the invention.

Referring now to FIG. 2 of the drawings, a rear elevational view (as viewed from an archer's point of view during aiming) of an exemplary arrow rest assembly 10 in accordance with the invention is shown. The arrow rest assembly 10 is adapted for connection to the riser of a compound archery bow (not shown) as will be described with respect to the various embodiments of the invention. However, the arrow rest assembly 10 can be adapted for use with any type of bow including, but not limited to, crossbows, recurve bows, reflex bows, longbows, and so on, as well as for use with other equipment associated with hunting, bowfishing, target practicing, and so on.

The exemplary arrow rest assembly 10 includes for example a closed annular support frame 12 with resilient support members 14 connected thereto. The support members 14 are circumferentially spaced around the support frame 12 and extend radially inwardly to form a central opening 16 within which the shaft 5 of an arrow 9 can be positioned. The support members 14 are normally stationary until an applied force causes them to flex, such as when the arrow is positioned in the opening 16 of the arrow rest or removed therefrom, or during shooting where the arrow shaft may initially deform due to high forces caused by sudden acceleration when the bowstring is first released, during passage of the arrow fletchings or vanes through radial gaps between the support members 14, and so on. In order to overcome one or more of the afore-describe difficulties of the prior art brush-type arrow rests, an adjustable arrow shaft support post 18 in accordance with the present invention is operably associated with the support frame 12 and can be adjusted upwardly or downwardly with respect thereto, as represented by arrows 20 and 22 in FIG. 2. Once adjusted, the support post 18 can be fixed in position with respect to the support frame 12.

The provision of an adjustable arrow shaft support post 18 ensures that the arrow shaft 5 can be centered within the central opening 16 so that the longitudinal axis of the arrow shaft is coincident with the axis of the central opening 16. The provision of the passport post 18 also ensures that the arrow shaft will be supported by the post during shooting and not by the resilient support members 14. In this manner, variations in arrow diameter can be accommodated to ensure that the arrow shaft is always centered in the opening of the arrow rest, thereby ensuring accuracy and consistency from shot to shot, while reducing or eliminating wear of the support members 14, which now function to capture the arrow shaft 5 within the central opening 16 when the arrow 9 is loaded into the arrow rest assembly 10, and to guide movement of the arrow shaft toward the arrow shaft support 18 when drawing back the archery bow to an aiming position, as well as movement of the arrow shaft when the arrow is loaded, unloaded, and/or launched. The support post 18 can be constructed of rigid or flexible material, and can be configured to remain stationary or alternatively flex or move towards a first position when the arrow is at rest and flex or move towards a second position when the arrow is launched to thereby accommodate temporary deformation of the arrow shaft upon launch and ensure a predictable and consistent trajectory of the arrow during flight.

The basic features of the above-described exemplary embodiment of the arrow rest assembly 10, some or all of which will be found in various embodiments of the invention described below, can greatly vary to accommodate a wide variety of bow types, arrow sizes and configurations, as well as user preferences and shooting styles. Accordingly, it will be understood that the size, configuration, shape, function, and capacity of the basic features of the invention, including the particular number and order of such features can greatly vary without departing from the spirit and scope of the invention.

Figure 3:
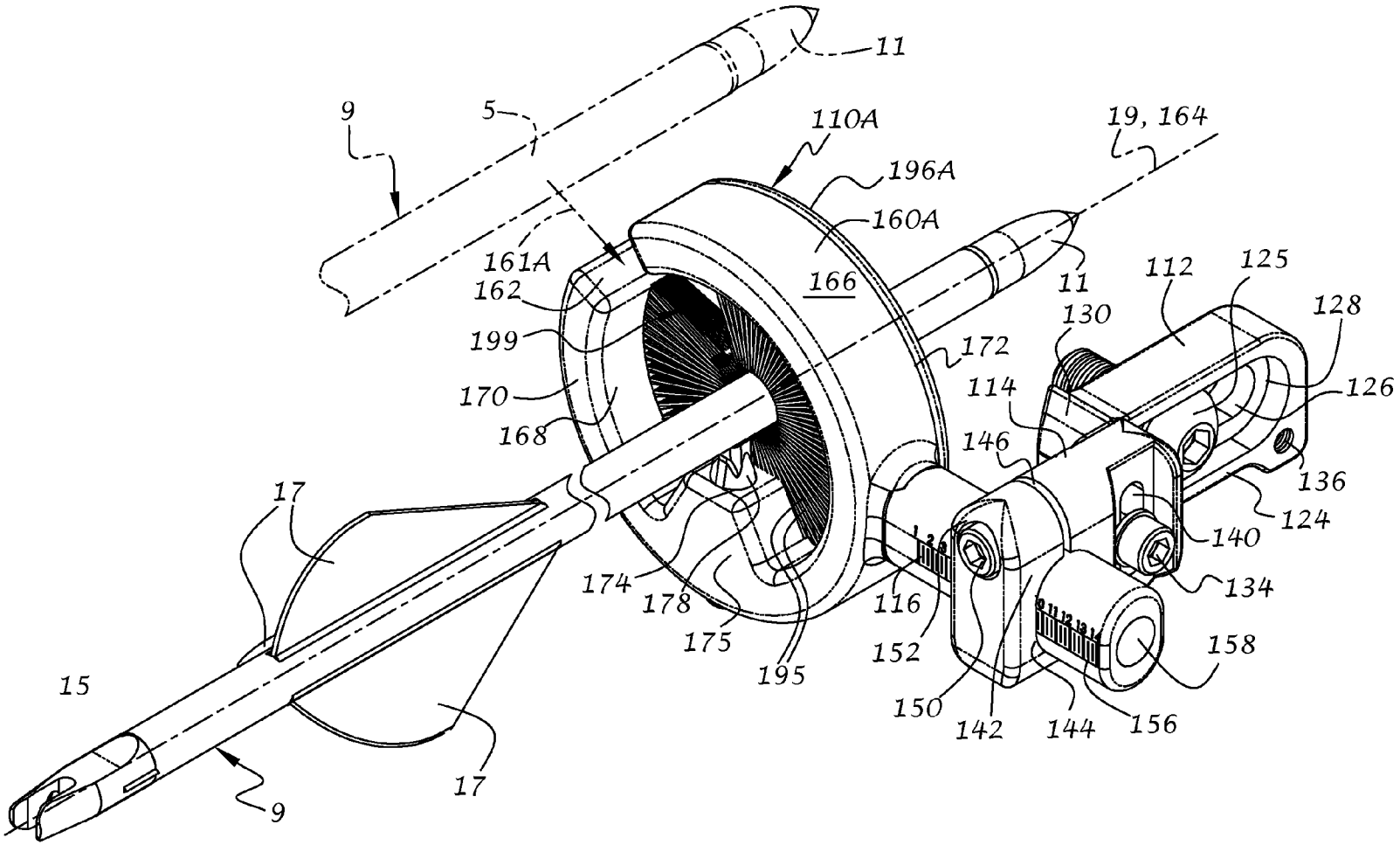
FIG. 3 is a rear isometric view of an open resilient arrow rest assembly in accordance with the present invention.
Figure 4:
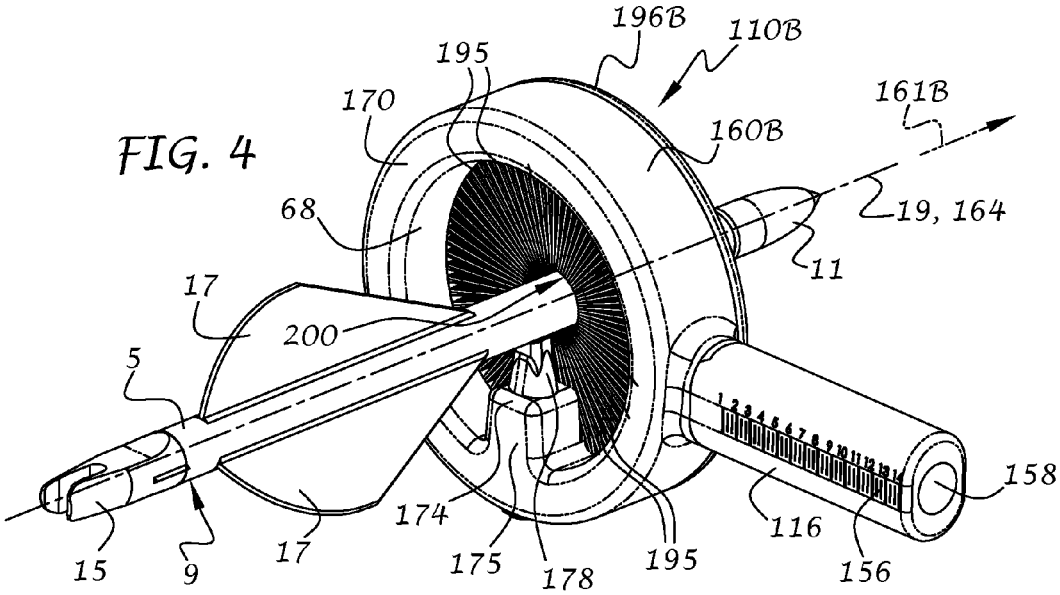
FIG. 4 is a rear isometric view of a closed resilient arrow rest assembly somewhat similar to FIG. 3 with the mounting bracket removed for clarity.
Figure 5:
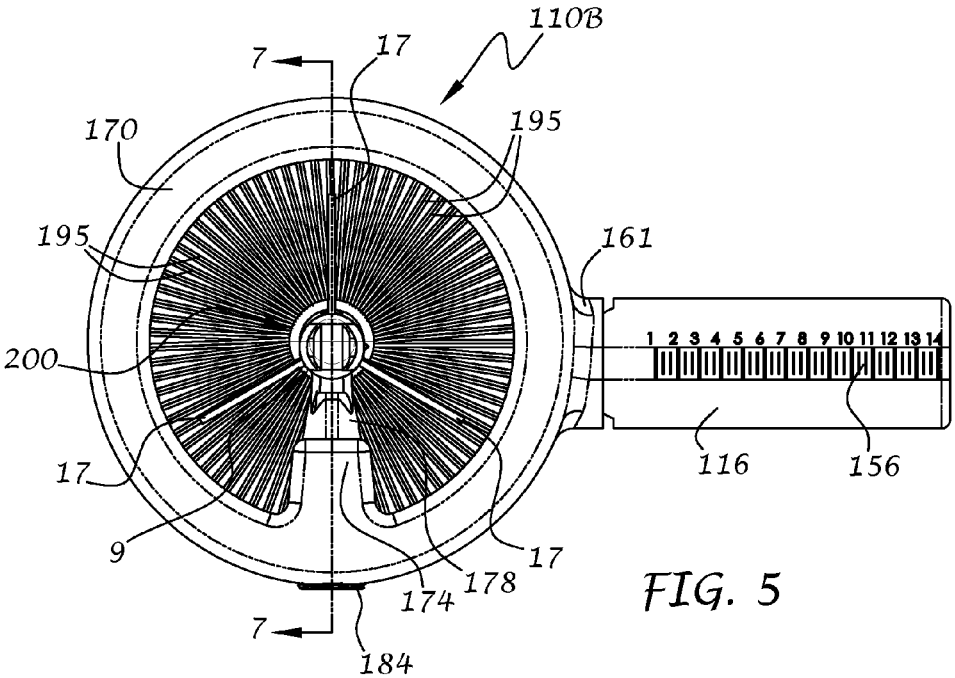
FIG. 5 is a rear elevational view of the resilient arrow rest assembly of FIG. 4.

Referring now to FIGS. 3-8, a first arrow rest assembly 110A (FIG. 3) and a second arrow rest assembly 110B (FIGS. 4-8) in accordance with exemplary embodiments of the invention are illustrated. In FIG. 3, the arrow rest assembly 110A includes a first annular support frame 160A with a wedge-shaped gap or opening 162 defining a partially open space for receiving an arrow 9 radially into the arrow rest. In FIGS. 4-8, the arrow rest assembly 110B has a first annular support frame 160B that is without the gap 162, defining a closed space for receiving the arrow 9 axially into the arrow rest. For purposes of illustration the arrow 9 is shown with an unusually short length, and therefore it will be understood that the arrow rest assemblies of the present invention can be adapted for use with any size arrow shaft without departing from the spirit and scope of the invention. The arrow 9 typically includes a tip 11 (FIG. 3) connected to a forward end of the shaft 5, a nock 15 connected to a rearward end of the shaft 5 for receiving a bowstring (not shown), and fletchings 17 connected to the shaft 5 and circumferentially spaced therearound. The fletchings 17 typically extend in a radial direction with respect to a central axis 19 of the arrow shaft.

The arrow rest assemblies 110A and 110B further include a first resilient support assembly 90 associated with the first annular support frame 160A and 160B, respectively, for supporting the shaft 5 of an arrow 9, a second resilient support or guide assembly 92 with a second annular support frame 196A (FIG. 3) or 196B (FIG. 4) for capturing and supporting the arrow shaft 5 within the arrow rest assembly, and a third annular support frame 202 for securing the second resilient support assembly 92 to the first annular support frame 160A or 160B.

With particular reference to FIG. 3, the arrow rest assemblies 110A and 110B are intended to be connected to the riser of an archery bow or the like (not shown) and to that end, can be provided with a mounting bracket 112, an elevation block 114 adjustably connected to the mounting bracket 112 for adjustment in a vertical direction, and a windage arm 116 adjustably connected to the elevation block 114 for adjustment in a horizontal direction. The windage arm 116 is in turn connected to the arrow rest assembly (110A or 110B). The mounting bracket 112, elevation block 114, and windage arm 116 are preferably adjustable such that the arrow rest assembly can be adjusted to a proper position with respect to a nocking point of a bowstring and a predefined location on the riser, such as the Berger hole (not shown) or other location, as is well known.

The mounting bracket 112 can be of conventional construction and includes an elongate base plate 124 that, when mounted to a bow or the like, extends in a generally horizontal direction. The base plate 124 includes an elongate slot 126 extending therethrough for receiving a fastener 125 or the like so that the mounting bracket 112 can be attached to the riser of a bow in a well-known manner. An elongate recess 128 is formed adjacent to and surrounds the groove so that the fastener head can be located within the mounting bracket 112. A connecting portion 130 of the mounting bracket 112 is located rearwardly of the elongate base plate 124 and extends in a transverse direction thereto, or in a generally vertical direction when the mounting bracket 112 is mounted to the bow or the like. Threaded openings (not shown) are formed in the connecting portion 130 for receiving a threaded fastener 134 or the like when connecting the elevation block 114 thereto. Threaded openings 136 (only one shown in FIG. 1) are also formed in the base plate 124 for receiving a set screw (not shown). Since the risers of most bows are provided with only a single mounting hole for connecting an arrow rest thereto, one or more set screws (not shown) can be used to press against the riser of a bow when the resilient arrow rest assembly 110A, 110B is connected thereto so that the arrow rest assembly does not rotate or otherwise move with respect to the riser.

The elevation block 114 includes an elongate slot 140 that extends in a generally vertical direction and is adapted to receive the threaded fastener 134 so that the elevation block 114 can be connected to the mounting bracket 112. The elongate slot ensures that a wide range of elevation adjustment is available to the user, while maintaining relatively low profiles of the mounting bracket 112 and elevation block 114, thereby reducing the size and material requirements. Although not shown, a scale can be located adjacent to the slot 140 or at other locations to assist the user with elevation adjustment.

The elevation block 114 has a clamping portion 142 for holding the windage arm 116 in an adjusted windage position with respect to the riser of a bow. The clamping portion 142 preferably includes a clamp opening 144 for receiving the windage arm 116, a slot 146 that extends from an upper end of the elevation block to the clamp opening 144, and a threaded fastener 150 that extends through a first transverse opening 152 in the elevation block on one side of the slot 146, and threads into a second transverse opening (not shown) on the opposite side of the slot 146 to adjustably clamp the windage arm 116 to the elevation block 114. A windage scale 156 can be located on a rear face of the windage arm 116 to facilitate windage adjustment.

The windage arm 116 is preferably complementary in shape to the clamp opening 144 and can include a central bore 158 to reduce weight and thus material costs. The central bore 158 is also useful for receiving a threaded fastener 159 (FIG. 6) that threads into an aperture 163 of a mounting protrusion 161 extending from the first annular support frame 160A (FIG. 3) or 160B (FIG. 6) of the arrow rest assembly 110A or 110B, respectively, for securing the windage arm 116 to the mounting protrusion 161. The mounting protrusion 161 is preferably integrally formed with the frame 160A or 160B, but can alternatively be separately formed and connected to the frame through fasteners, cooperating mechanical features, adhesive bonding, or other well-known connection means.

Figure 6:
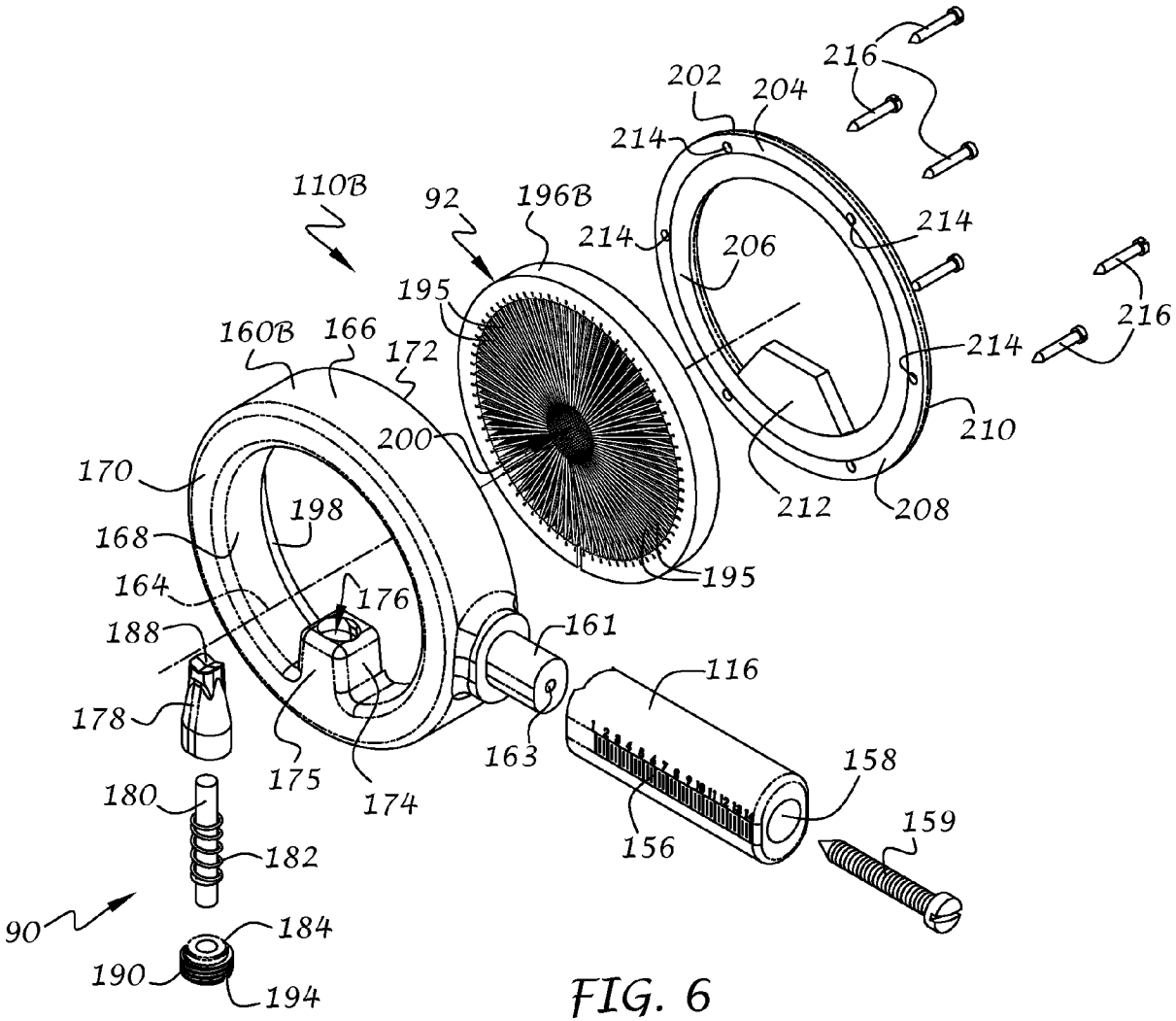
FIG. 6 is a rear isometric exploded view of the arrow rest assembly of FIG. 4.

In FIGS. 3 and 6, each arrow rest 110A, 110B is configured for use with a right-handed archer with the provision of the mounting protrusion 161 as shown. The arrow rest can also be configured for a left-handed archer by removing the arrow rest assembly from the clamping portion of the elevation block 114 and reconnecting it to the opposite side thereof. In the left hand configuration, the wedge shaped gap 162 for receiving the arrow 9 is now located in the upper right quadrant, the opposite side of the central opening 200 as for the right hand configuration. The post 178 can also be reversed, depending on the preferences of the shooter. The mounting bracket can also be removed, flipped over and readjusted as necessary to accommodate the left-hand mounting arrangement and achieve the proper height of the arrow rest with respect to the reference point of the riser of the bow. Thus, the present invention can be adaptable for both right-handed and left-handed archers without the need for separate parts or assemblies, thereby reducing material and manufacturing costs.

Although the windage arm 116 is shown mechanically fastened to the arrow rest assembly, it will be understood that the windage arm can be fastened through adhesive bonding, welding, friction fit, and other connection means, as well as integrally forming the windage arm 116 with the first annular support frame.

Referring now to FIGS. 3-8, the arrow rest assembly 110A and 110B will now be described in greater detail. In the FIG. 3, embodiment, the wedge-shaped gap or opening 162 is formed in the first annular support frame 160A so that the shaft 5 of an archery arrow 9 can be loaded into the arrow rest assembly 110A in a generally radial direction, as represented by directional arrow 161A. In the FIG. 4 embodiment, the first annular support frame 160B is similar in construction to the first annular support frame 160A, with the exception that the gap 162 is not present. With this arrangement, the arrow 9 is loaded into the arrow rest assembly in an axial direction, as shown by direction arrow 161B, preferably coaxial with a central axis 164 (FIG. 4) of the annular support frame 160B.

No matter how the first annular support frame 160A and 160B may be configured for loading an arrow 9, they both have several features in common. For example, each annular support frame has an outer curved surface 166 and an inner curved surface 168 with a rear surface 170 and a spaced front surface 172 extending between the outer and inner curved surfaces. The outer and inner curved surfaces are preferably coaxial with the central axis 164.

The first resilient support assembly includes a support base 174 that extends upwardly from a lower-most portion of the inner curved surface 168 and is located more towards the rear of the first annular support frame than towards the front thereof. As shown in FIG. 6, the support base 174 can be formed integrally with the first annular support frame and includes a rear surface 175 that is flush with the rear surface 170. However, it will be understood that the support base 174 can be located at any suitable position with respect to the annular support frame.

Figure 1A:
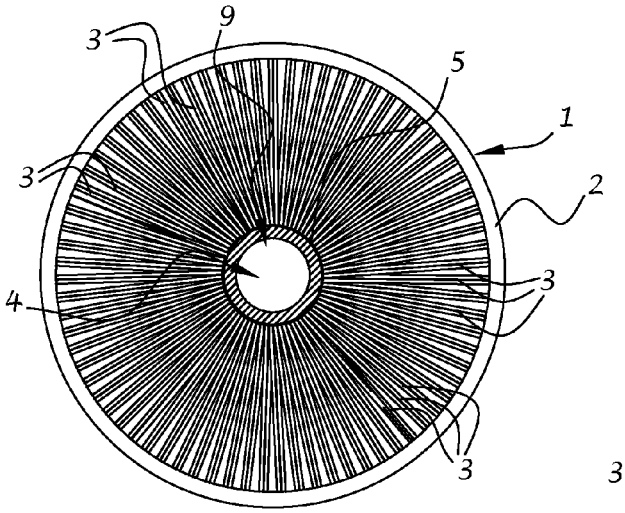
FIG. 1A (Prior Art)
FIG. 1A is a rear elevational diagrammatic view of a prior art arrow rest showing an arrow shaft in cross section that is too large for the central opening of the arrow rest.
Figure 1B:
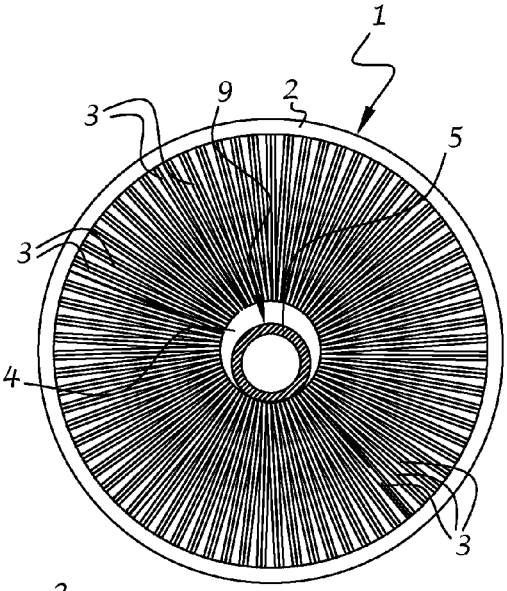
FIG. 1B (Prior Art)
FIG. 1B is a similar rear elevational diagrammatic view of the prior art arrow rest showing an arrow shaft in cross section that is too small for the central opening of the arrow rest.
Figure 7:
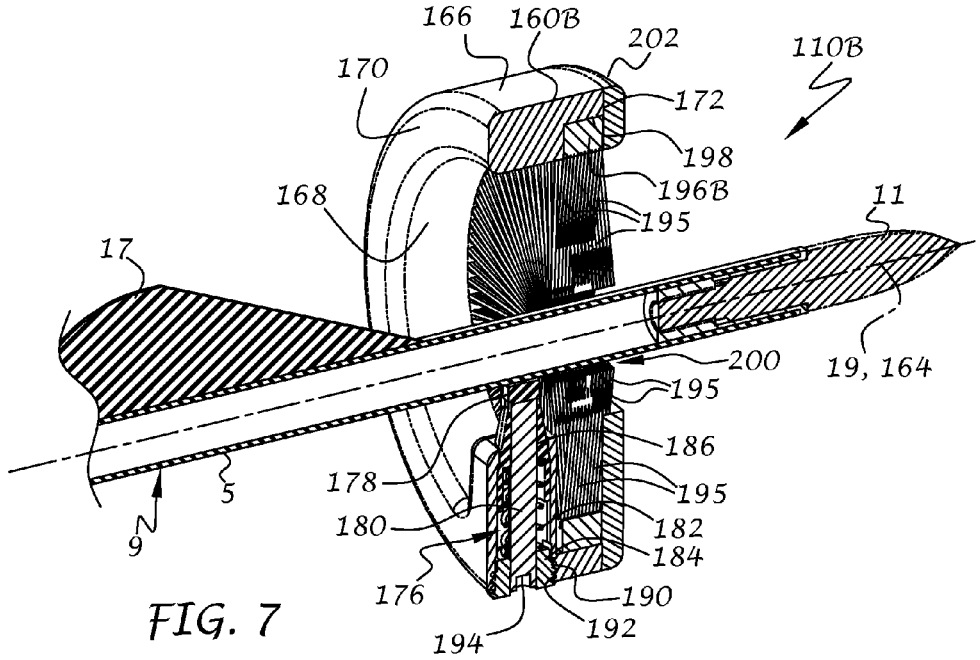
FIG. 7 is an isometric sectional view of the arrow rest assembly taken along line 7-7 of FIG. 5.
Figure 8:
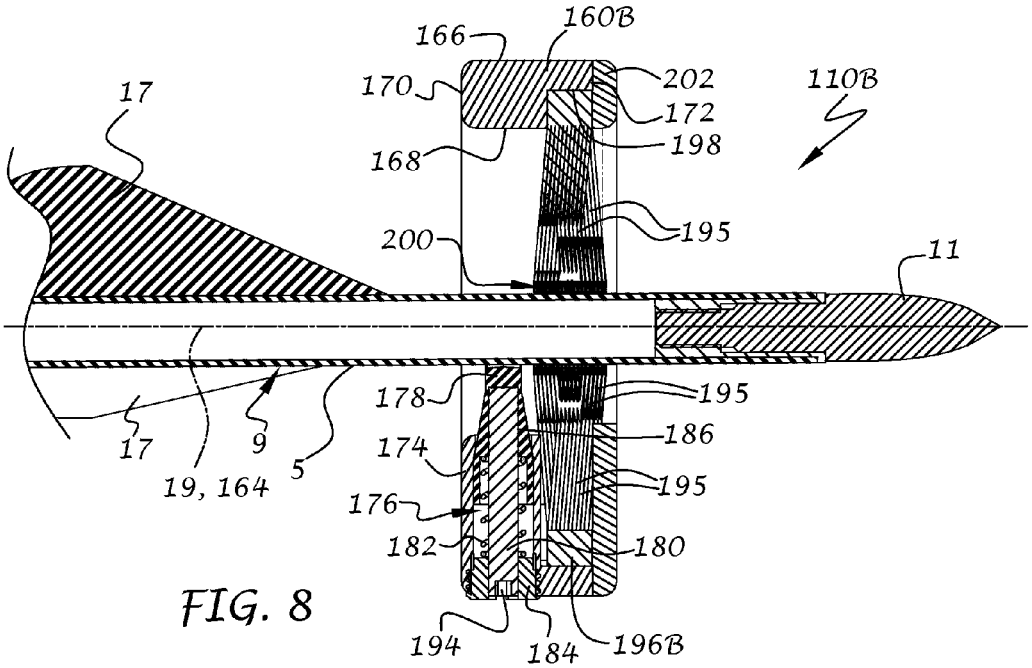
FIG. 8 is an elevational sectional view thereof.
Figure 9:
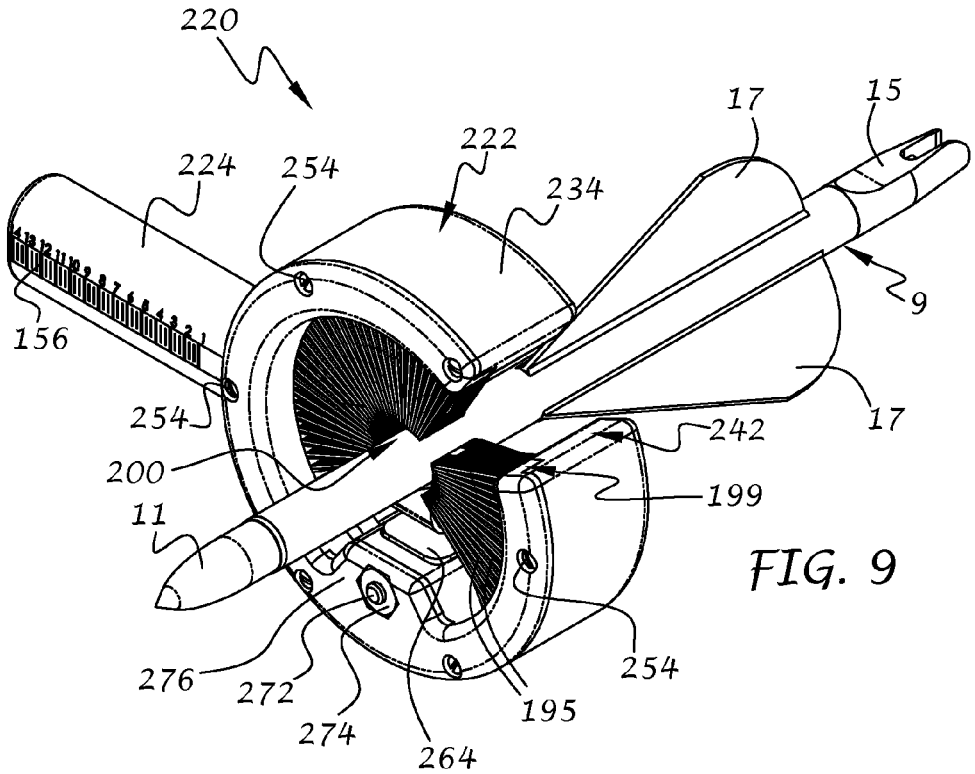
FIG. 9 is a front isometric view of a resilient arrow rest assembly with an attached arrow in accordance with a further embodiment of the invention.
Figure 10:
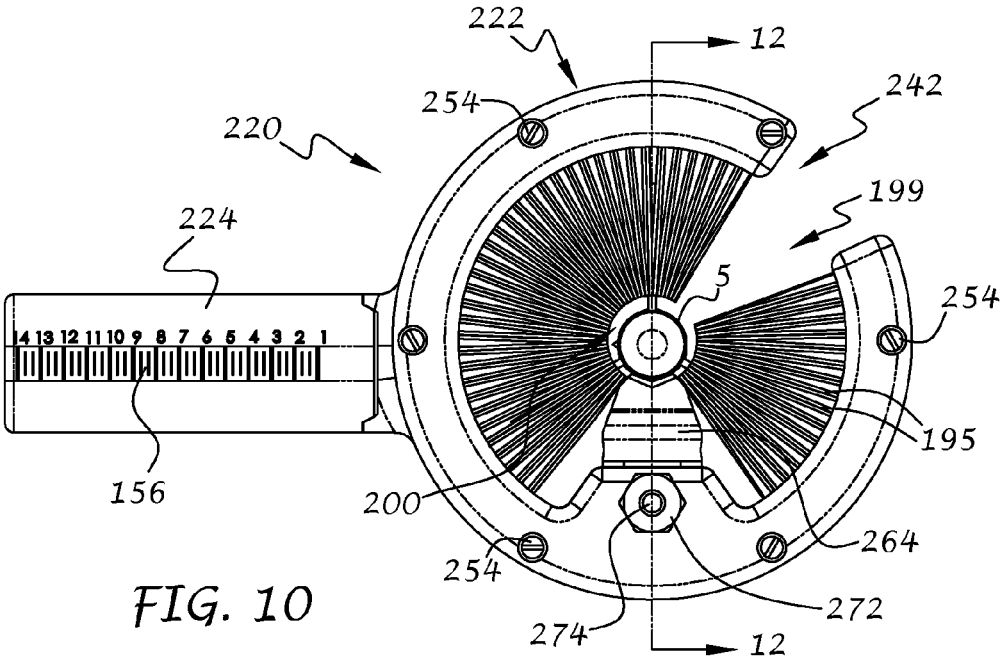
FIG. 10 is a front elevational view thereof.

As best shown in FIGS. 6-8, a cavity 176 is formed in the support base 174 and is sized to receive a first resilient support member or post 178, which in turn supports the shaft 5 of an arrow 9 (FIG. 1). The first resilient support member 178 extends radially upwardly from the base 174 toward the central axis 164 of the support frame 160A or 160B and is adjustable toward and away from the central axis 164, so that the longitudinal centerline of an arrow shaft 5 (FIG. 1) can be made coincident with the central axis 164 when positioned in the arrow rest assembly. A guide rod 180 is slidably received in a bore 186 of the first resilient support member 178. A biasing member, comprising a compression spring 182, is positioned around the guide rod 180. An adjustment member 184 receives the guide rod 180, preferably in a press-fit installation, so that the guide rod and adjustment member 184 are fixed together. It will be understood that the guide rod 180 can be secured to the adjustment member 184 through any well-known connection means or may be integrally formed therewith.

The spring 182 normally presses against the adjustment member 184 and the support member 178 to bias the resilient support member 178 upwardly toward the central axis 164. Sufficient gaps between the spring coils are provided to allow the support member to travel downwardly against the biasing forces when opposing forces are applied, such as when the arrow 9 is first released or shot from an archery bow, causing temporary deformation of the arrow shaft due to high acceleration forces applied to the arrow. In this manner, arrow flexure during shooting can be accommodated to thereby improve accuracy and consistency from shot to shot. An upper support surface 188 of the first resilient support member 178 includes a channel or groove for receiving the arrow shaft 5 to help center the arrow shaft on the first support member 178 during aiming and shooting, as well as during transportation where an arrow may be loaded on the arrow rest but not yet drawn back.

The complementary shapes of the first resilient support member 178 and cavity 176 ensure that the first resilient support member 178 will be fixed against rotational movement about a vertical axis or the like with respect to the support base 174. To that end, the support member 178 and the cavity 176 can be constructed of any shape that prevents relative rotational movement between the resilient support member and the cavity.

The adjustment member 184 has an outer threaded surface 190 that meshes with an inner threaded surface 192 of the cavity 176. A slot 194 is formed in the bottom of the adjustment member 184 and is engageable by a screwdriver or other tool to rotate the adjustment member in a clockwise or counterclockwise direction to thereby adjust the height of the first resilient support member 178 to accommodate different arrow shaft diameters. Ideally, the central axis 164 of the annular support frame 110A, 110B should be coincident with the central axis of the arrow shaft 9, which is made possible by the provision of the first resilient support member 178 in accordance with the invention.

In accordance with a further embodiment of the invention the support member 178 may be adjusted to a desired position then fixed against further upward movement. Further rotation of the adjustment member 184 can then be used to adjust the amount of opposing flexural forces or resilience of the support member 178 under applied forces from the arrow 9 during shooting for example.

As best shown in FIGS. 6-8, the second resilient support assembly 92 of the arrow rest assembly 110A, 110B also preferably includes a plurality of second resilient support members or guide members 195 connected to a second annular support frame 196A (FIG. 3) for the arrow rest assembly 110A, as well as the second annular support frame 196B (FIGS. 4 and 6) for the arrow rest assembly 110B. The second annular support frames 196A and 196B are somewhat similar in construction and each is configured as a disk-shaped body that fits into an annular groove 198 formed in a forward end of the inner curved surface 168 of the first support frame 160A or 160B.

The second annular support frame 196A (FIG. 3) of the rest assembly 110A includes a wedge-shaped gap or opening 197 (FIG. 11) corresponding to the gap or opening 162 of the first annular support frame 160A so that the shaft 5 of an archery arrow 9 can be loaded into the arrow rest assembly 110A in a generally radial direction, as represented by directional arrow 161A in FIG. 3. In this configuration, the second resilient support members also form a second wedge-shaped gap 199 (FIG. 3) for receiving the arrow shaft. The second annular support frame 196B for the arrow rest assembly 110B is preferably formed without the wedge-shaped gap, and therefore the arrow shaft 5 is loaded axially into the arrow rest assembly 110B as previously described.

The second resilient support members 195 extend generally radially inwardly from the second annular support frame 196A or 196B to form a central opening 200 through which the arrow 5 extends during loading, unloading, aiming, and shooting, for example. The central opening 200 has a diameter that is equal to or preferably greater than the diameter of the largest anticipated arrow shaft. In this manner, frictional forces that might otherwise act on the arrow shaft during shooting can be substantially reduced or eliminated.

During the above-mentioned activities, the second resilient support members 195 ensure that the arrow shaft remains within the central opening 200 and does not inadvertently leave the center of the arrow rest, which can easily happen when the archery bow is tilted or canted at too steep of an angle to normally keep it centered within the arrow rest. The second resilient support members 195 are also suitable for keeping the arrow generally centered in the arrow rest during hunting or while walking or hiking to an anticipated location, for example, where there exists the possibility that game may be stumbled upon. In such circumstances, it may well be desirous to have an arrow preloaded for quickly and quietly drawing back the bow, aiming, and shooting, while bypassing the typical loss of time, generation of noise, and fumbling that might otherwise occur with prior art devices that do not properly capture the arrow shaft. Thus, even if a prior art arrow rest is preloaded with an arrow, the failure to properly capture the arrow shaft within a predefined central area of the arrow rest causes an archer to lose precious time as the position of the arrow is checked, adjusted, rechecked, prior to drawing back the bow. Under these conditions, and in combination with the adrenalin rush or elevated state of excitement, opportunities to obtain the intended target may very well be lost.

In order to ensure that the arrow shaft 5 is properly captured during such activities or for various other reasons, the second resilient support rest is constructed to ensure the retention of the arrow shaft within a predefined central area of the arrow rest assembly. The second resilient support members 195 preferably comprise brushes or bristles that are embedded in the second annular support frame 196A, 196B during the manufacturing process, such as through insert-molding, crimping, or other means for fixing the second resilient support members to the second annular support member. Preferably, the brushes contain several strands that extend radially inwardly from the second annular support frame.

As shown, the brushes do not fill the entire thickness or volume from the front to rear surfaces within the first annular support frame, but only occupy a portion thereof so that much of the support will be provided by the first resilient support member when the archer is in an aiming position. In this manner, with the arrow shaft 5 centered in the opening 200, the second resilient support members 195 ensure that the arrow shaft 5 is captured in a somewhat centered position or predefined central area within the arrow rest. In this position, the bow can be quickly drawn back to the aiming position from a relaxed or undrawn position since the second resilient support members in combination with the first resilient support member will tend to move the arrow shaft into the proper position during drawback of the bow.

Although the opening 200 is shown as circular in shape and of a particular size relative to the shaft of an arrow, it will be understood that the opening 200 can be of any suitable shape and size so long as the arrow shaft is retained in the arrow rest at a position where it can be easily guided towards the first resilient support member, such as by tilting or canting the bow to move the arrow shaft, and/or when the bow is drawn back to an aiming position.

As best shown in FIGS. 6-8, the third annular support frame 202 has an outer circular surface 204, an inner circular surface 206, a rear surface 208, and a spaced front surface 210 extending between the outer and inner surfaces to form a ring-shaped body. A base member 212 extends upwardly from the inner surface 206 and is in alignment with the support base 174 when assembled. Apertures 214 extend through the thickness of the third annular support frame 202 and are spaced circumferentially therearound. Fasteners 216 extend through the apertures 214 and thread into the first annular support frame 160A (FIG. 3) or 160B to sandwich the second annular support frame 196A or 196B between the first annular support frame 160A, 160B and the third annular support frame 202. It will be understood that the second annular support frame 196A or 196B can be directly secured to the first annular support frame through other fastening arrangements, adhesive bonding, or other connecting means, to thereby eliminate the third annular support frame without departing from the spirit and scope of the invention.

In use, the first resilient support assembly 90 and the second resilient support assembly 92, including the first resilient support member 178 and the second resilient support members 195, are preferably of sufficient flexibility so that they guide the arrow shaft toward the central opening 200 of the arrow rest 18 when the arrow is loaded into the arrow rest, and then flex back to their original state when the arrow shaft is positioned on the first resilient support member 178 to thereby capture the arrow and prevent it from moving off of the arrow rest, or at least keep it within the vicinity of the first resilient support member so that the arrow shaft naturally moves or gravitates toward the upper surface of the first resilient support member 178 when the archer tilts, cants, and/or assumes an aiming or shooting stance with the archery bow. When the arrow is shot from the bow and experiences temporary deformation due to the sudden high acceleration forces, the first resilient support member 178 is sufficiently resilient to accommodate the temporary deformation, while the second resilient support members 195 are sufficiently stiff in the radial direction to ensure that the arrow trajectory remains constant. Likewise, the second resilient support members 195 are sufficiently resilient in the axial direction to accommodate movement of the arrow fletchings as they pass between the second resilient support members 195. Since all fletchings pass between the second resilient support members as the arrow passes through the arrow rest assembly, any friction experienced between the arrow fletchings 17 (FIG. 3) and the support members 195 will be substantially equal, thus assuring a consistent and predictable arrow flight path to its intended target from shot to shot.

It will be understood that the present invention is not limited to a circular configuration of resilient support members as shown, but may have more or less resilient supports members, groups of bristles or supports of any suitable configuration or shape, or any other suitable support structure that tends to guide the arrow toward the center of the rest and captures the arrow within a predefined central area thereof when loaded, without departing from the spirit and scope of the invention.

It will be further understood that the second resilient support members need not be located at the forward end of the arrow rest as shown, but may be located at a center section or rearward end thereof, or may extend across the entire width of the first annular support frame 160A or 160B, from the front surface 172 to the rear surface 170 thereof.

Referring now to FIGS. 9-13, a resilient arrow rest assembly 220 in accordance with a further embodiment of the invention is illustrated. The resilient arrow rest assembly 220 has a first annular support frame 222 configured as a partially open structure with a central axis 232 for receiving an arrow 9 radially into the arrow rest assembly, as previously described with reference to the FIG. 3 embodiment for example. As in the previous embodiments, the arrow rest assembly 220 is intended to be connected to the riser of a bow or the like (not shown) and therefore can be provided with a windage arm 224 or other mounting structure connected to or for connection to the first annular support frame 222 via a mounting protrusion 161 or other connecting means as previously described, for connection to a mounting bracket (such as mounting bracket 112 in FIG. 3) which is in turn connected to the riser of an archery bow (not shown).

The resilient arrow rest assembly 220 further includes a first resilient support assembly 230 connected to a third annular support frame 246 for supporting the shaft 5 of an arrow 9, and a second resilient support or guide assembly 292 positioned between the first annular support frame 222 and the first resilient support assembly 230 for capturing and supporting the arrow shaft 5 within the arrow rest assembly 220. In this embodiment, the first resilient support assembly 230 is positioned forwardly of the second resilient support assembly 292 instead of rearwardly as in the previous embodiments.

The first annular support frame 222 has an outer curved surface 234 and an inner curved surface 236 with a rear surface 238 and a spaced front surface 240 extending between the outer and inner curved surfaces. A wedge-shaped gap or opening 242 is formed in the first annular support frame 222 between the outer and inner curved surfaces for receiving the shaft 5 of an arrow in a generally radial direction during loading and unloading (as shown in FIG. 3 for example). An annular groove 244 is formed in the inner curved surface 236 and extends rearwardly from the front surface 240 of the first annular support frame 222 for receiving the first and second resilient support assemblies.

Figure 11:
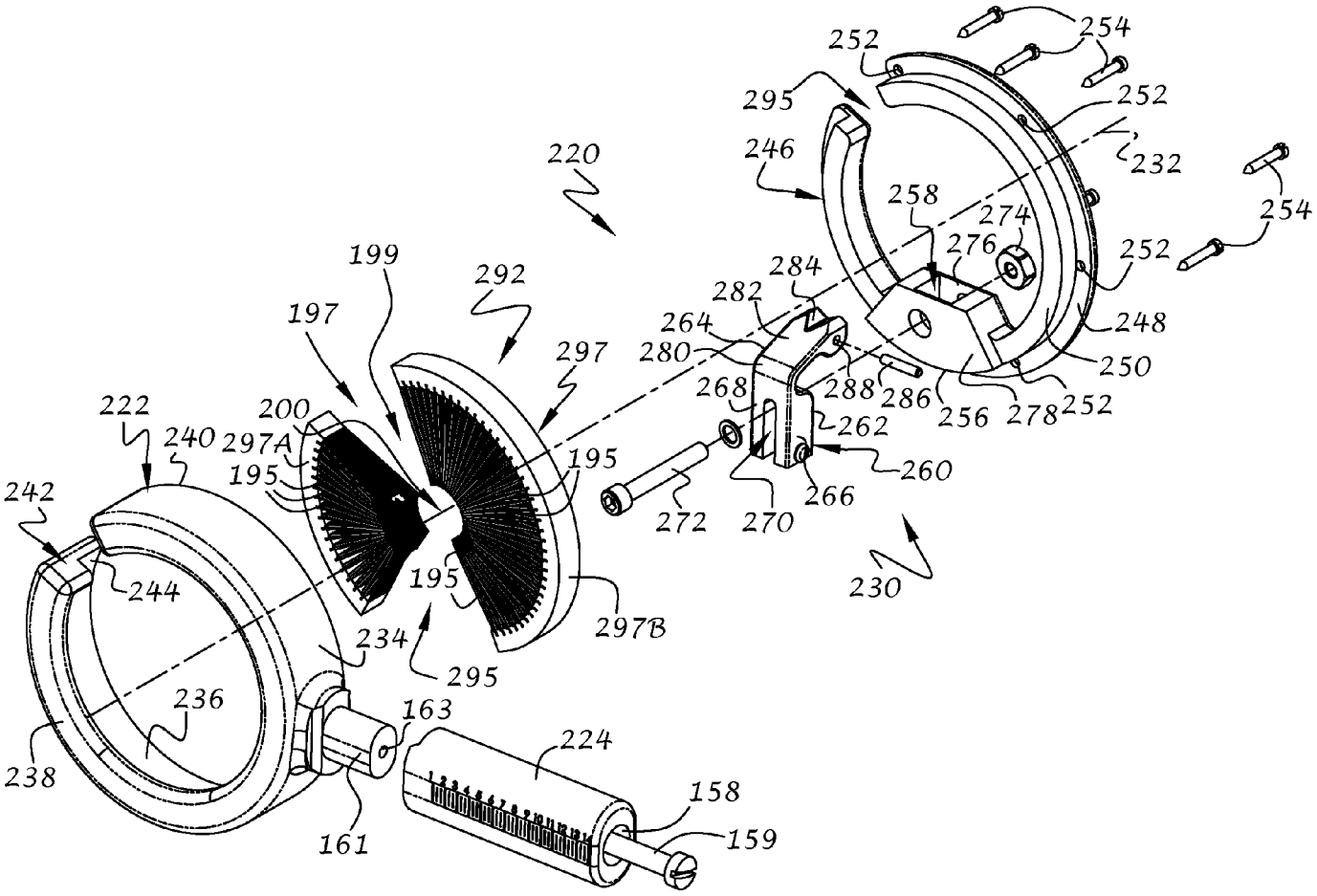
FIG. 11 is a front isometric exploded view thereof.
Figure 12:
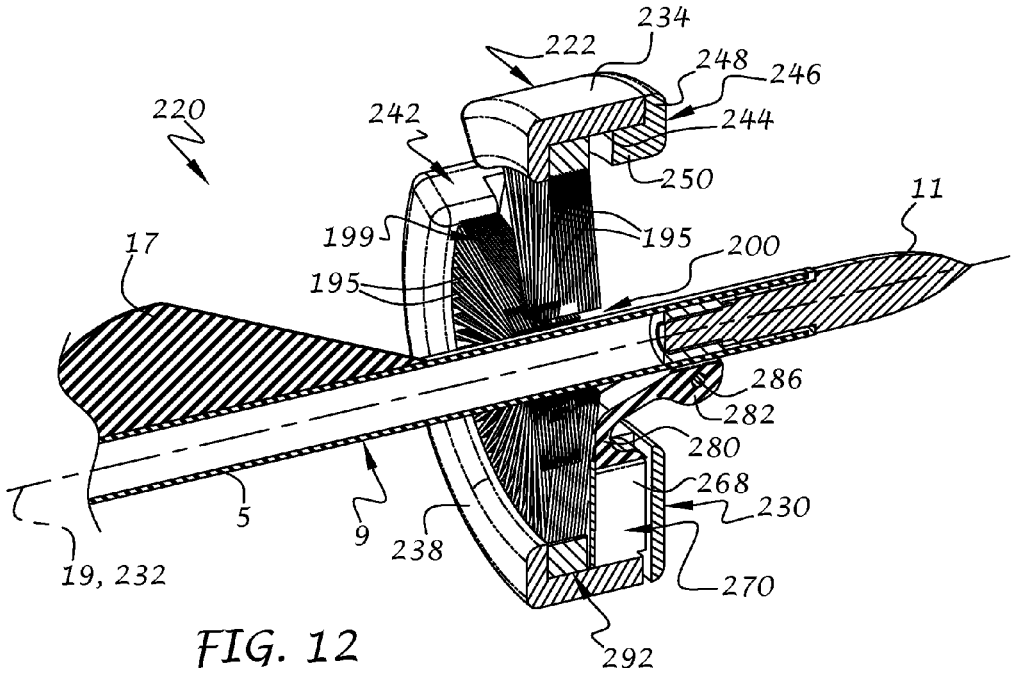
FIG. 12 is an isometric sectional view thereof taken along line 12-12 of FIG. 10.
Figure 13:
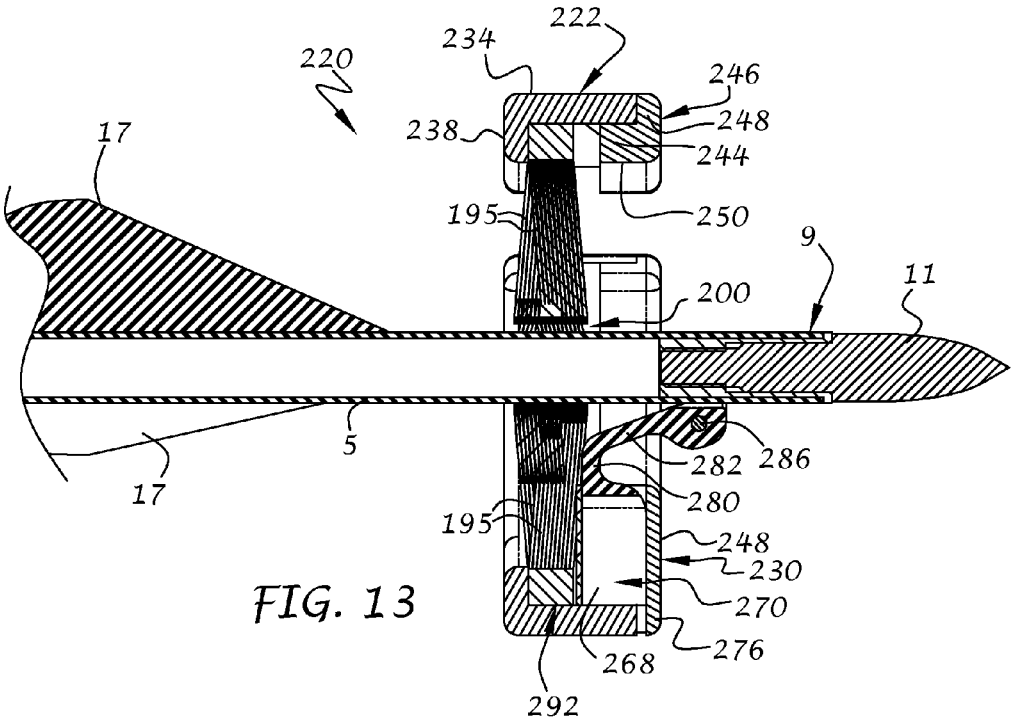
FIG. 13 is an elevational sectional view thereof taken along line 12-12 of FIG. 10.
Figure 14:
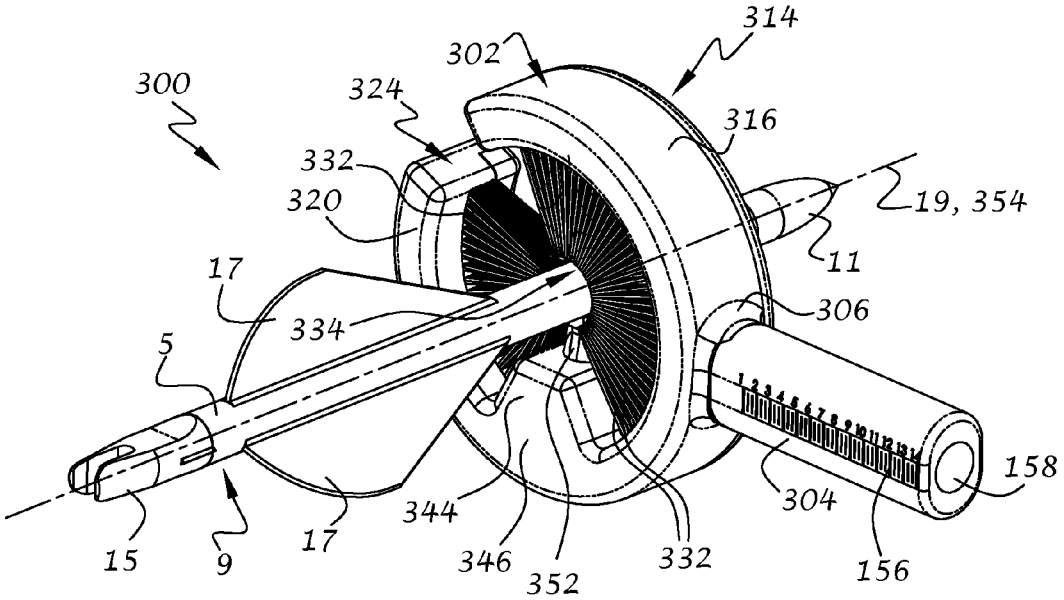
FIG. 14 is a rear isometric view of a resilient arrow rest assembly with an attached arrow in accordance with yet a further embodiment of the invention.
Figure 15:
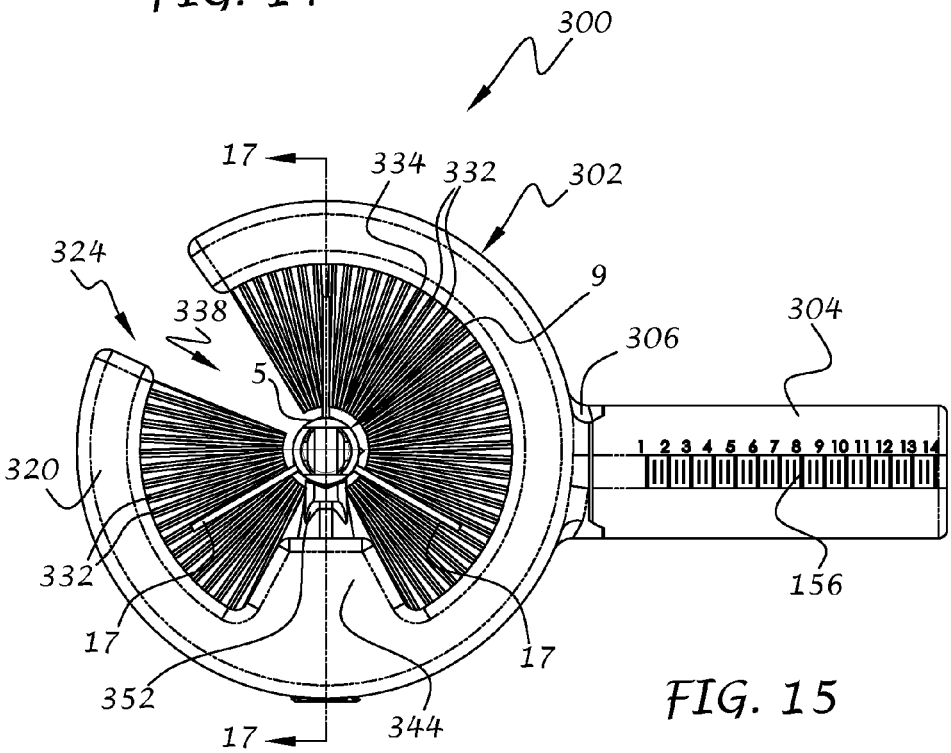
FIG. 15 is a rear elevational view thereof.

As best shown in FIGS. 11-13, the second resilient support assembly 292 of the arrow rest assembly 220 is similar to the assembly 92 previously described, and further with the provision of a third wedge-shaped gap 295 for accommodating a support base 256 associated with the third annular support frame 246. The third gap 295 together with the first gap 197 divide the second annular support frame 297 into semi-circular support frame segments 297A and 297B. Each segment comprises a plurality of second resilient support members 195 extending radially inwardly from frame segments 298A and 298B, that together form the central opening 200 for receiving an arrow shaft. The central opening 200 is preferably coaxial with the central axis 232, but may be positioned off-center without departing from the spirit and scope of the invention. A first wedge-shaped gap 197 is formed in the support frame 196A and a second aligned wedge-shaped gap 199 is formed with the support members 195. The gaps 197 and 199 together with the gap 242 of the first support frame 240 are sized to receive and capture the arrow shaft in a generally radial direction, as previously described. The second annular support frame 297 is configured as disk-shaped frame or rim segments that are received into the annular groove 244 of the first annular support frame 222, and are retained therein by the third annular support frame 246 of the first resilient support assembly 230.

As best shown in FIG. 11, the third annular support frame 246 of the first resilient support assembly 230 preferably includes a front wall 248 and a generally circular protrusion 250 that extends rearwardly from the front wall. The protrusion 250 is received in the annular groove 244 of the first annular support frame 222 for axially aligning the third annular support frame with the first annular support frame 222 and the second annular support frame 196A. Apertures 252 are formed in the front wall for receiving fasteners 254 that thread into the first annular support frame 222 to thereby secure the support frames together with the second support frame 196A, including the segments 297A and 297B of the second resilient support assembly 292, sandwiched between the first and third support frames.

The support base 256 extends upwardly from the third annular support frame 246 and can be integrally formed therewith. As shown, the support base 256 extends across the thickness of the support frame 246, from the front wall 248 to the protrusion 250. The support base is also generally wedge-shaped to accommodate the radially extending second support members 195. A cavity 258 is formed in the support base 256 and is sized to receive a first resilient support member or post 260 that functions to support the arrow shaft 5 (FIG. 9) when positioned in the arrow rest 220. The first resilient support member 260 has a first connecting section 262 located within and extending from the cavity 258 radially upwardly therefrom, and a second support section 264 extending upwardly and forwardly from the first connecting section 262.

The complementary shapes of the connecting section 262 and cavity 258 ensure that the first resilient support member 260 will be fixed against rotational movement about a vertical axis or the like with respect to the support base 256. To that end, the connecting section 262 and the cavity 258 can be constructed of any shape that prevents rotational movement of the resilient support member within the cavity.

The first resilient support member 260 is vertically adjustable in the cavity 258 so that arrow shafts with different diameters can extend coaxially with the opening 200 of the second resilient support assembly 292, and thus the annular support frames. The first connecting section 262 of the first adjustable support member 260 is formed with a pair of spaced legs 266 and 268 with a slot 270 extending therebetween. A fastener 272 extends through the rear wall 278 and forward wall 276 of the support base 256 as well as the slot 270 of the first connecting section 262. A nut 274 is embedded in the forward wall 276 of the support base 256 for receiving the fastener 272. In order to adjust the height of the first resilient support member 260, the fastener 272 is loosened, and the first resilient support member is slid upwardly or downwardly in the cavity 258 with respect to the fastener 272 until the desired height is achieved for the support section 264. Subsequently, the nut 274 and fastener 272 are tightened to thereby sandwich the connecting section 262 within the support base 256 in a fixed manner.

A first integral hinge section 280 is formed or otherwise located between the connecting section 262 and the support section 264 so that the support section 264 can flex to allow the support section to rotate downwardly against biasing forces created by the first integral hinge section 280 when opposing forces are applied, such as when the arrow 9 is first shot from an archery bow, causing temporary deformation in the arrow shaft due to high acceleration forces applied to the arrow. In this manner, arrow flexure during shooting can be accommodated to thereby improve accuracy and consistency from shot to shot.

The first resilient support member 260 is preferably constructed of a suitable material that, together with the geometry of the integral hinge section 280, provides the requisite biasing or resistance forces on the one hand to support the arrow shaft, and the requisite flexibility on the other hand to flex under arrow shaft deformation when the arrow is launched. An upper support surface 282 (FIG. 11) of the support section 264 of the first resilient support member 260 includes a channel or groove 284 for receiving the arrow shaft 5 to facilitate centering the arrow shaft thereon during drawback of the bow as well as during aiming and shooting, as previously described. A pin 286 can be inserted into an aperture 288 of the support section 264 to both stiffen the support section in the vicinity of the groove 284 and provide a bearing surface for the arrow shaft when the support section 264 begins to wear.

The combination of the first resilient support member 260 and the second resilient support members 195 and their flexible or resilient natures facilitate guidance of the arrow shaft toward the central opening 200 of the arrow rest and then flex back to their original state when the arrow shaft is positioned on the first resilient support member 260 to thereby capture the arrow and prevent it from moving off of the arrow rest, or at least keep it within the vicinity of the first resilient support member within the opening 200 so that the arrow shaft can be quickly and automatically positioned thereon when the archer assumes a shooting stance with the archery bow. When the arrow is shot from the bow and experiences temporary deformation due to the sudden high acceleration forces, the first resilient support member 260 is sufficiently flexible to accommodate this temporary deformation while the second resilient support members 195 are sufficiently stiff in the radial direction to guide arrow movement. Since all arrow fletchings 17 pass between the second resilient support members as the arrow passes through the arrow rest assembly, any friction experienced between the arrow fletchings 17 (FIG. 3) and the support members 195 will be substantially equal, thus assuring a consistent and predictable arrow flight path to its intended target from shot to shot.

It will be understood that the present embodiment of the invention is not limited to a circular configuration of resilient support members as shown, but may have more or less resilient support members, groups of bristles or supports of any suitable configuration or shape, or any other suitable support structure that tends to guide the arrow toward the center of the rest and captures the arrow within a predefined central area thereof when loaded, without departing from the spirit and scope of the invention.

Referring now to FIGS. 14-18, a resilient arrow rest assembly 300 in accordance with a further embodiment of the invention is illustrated. The resilient arrow rest assembly 300 has a first annular support frame 302 configured as a partially open structure for receiving an arrow 9 radially into the arrow rest assembly, as previously described with reference to the FIG. 3 embodiment for example. As in the previous embodiments, the arrow rest assembly 300 is intended to be connected to the riser of a bow or the like (not shown) and therefore can be provided with a windage arm 304 or other mounting structure connected to the first annular support frame 302 via a mounting protrusion 306 as previously described, for connection to a mounting bracket (such as mounting bracket 112 in FIG. 3) which is in turn connected to the riser of an archery bow (not shown).

The resilient arrow rest assembly 300 further includes a first resilient support assembly 310 connected to the first annular support frame 302 for supporting the shaft 5 of an arrow 9, and a second resilient support or guide assembly 312 positioned between the first annular support frame 302 and a third annular support frame 314 for capturing and supporting the arrow shaft 5 within the arrow rest assembly 300. In this embodiment, the first resilient support assembly 310 is positioned centrally or coincident with the second resilient support assembly 312 instead of rearward or forward of the second support assemblies of previous embodiments.

The first annular support frame 302 has an outer curved surface 316 and an inner curved surface 318 with a rear wall 320 and a spaced front wall 322 extending between the outer and inner curved surfaces. A wedge-shaped gap or opening 324 is formed in the first annular support frame 302 between the outer and inner curved surfaces for receiving the shaft 5 of an arrow in a generally radial direction during loading and unloading (as shown in FIG. 3 for example). An annular groove 326 is formed in the inner curved surface 318 and extends rearwardly from the front wall 322 of the first annular support frame 302 for receiving the second resilient support assembly 312.

Figure 16:
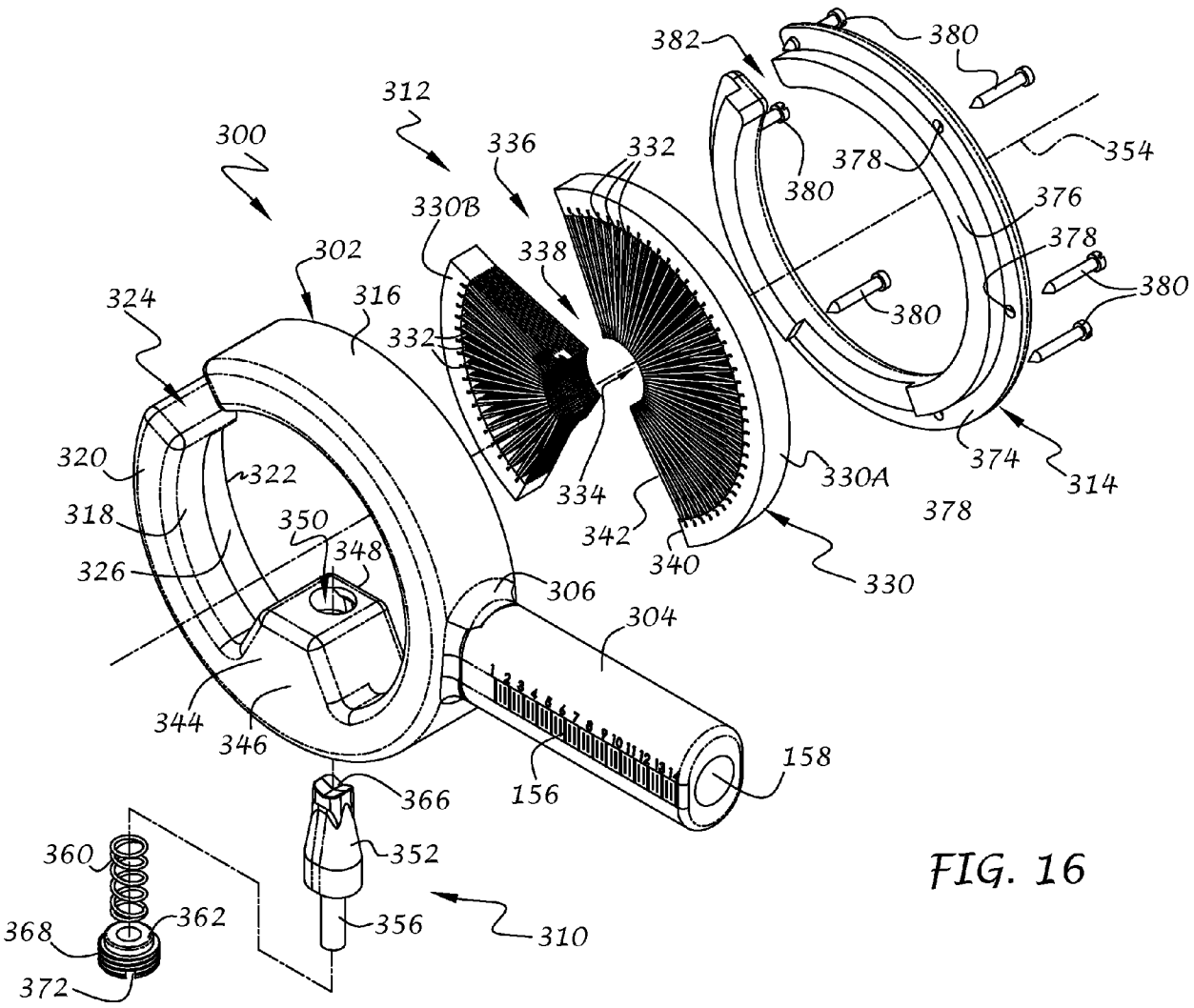
FIG. 16 is a rear isometric exploded view thereof.
Figure 17:
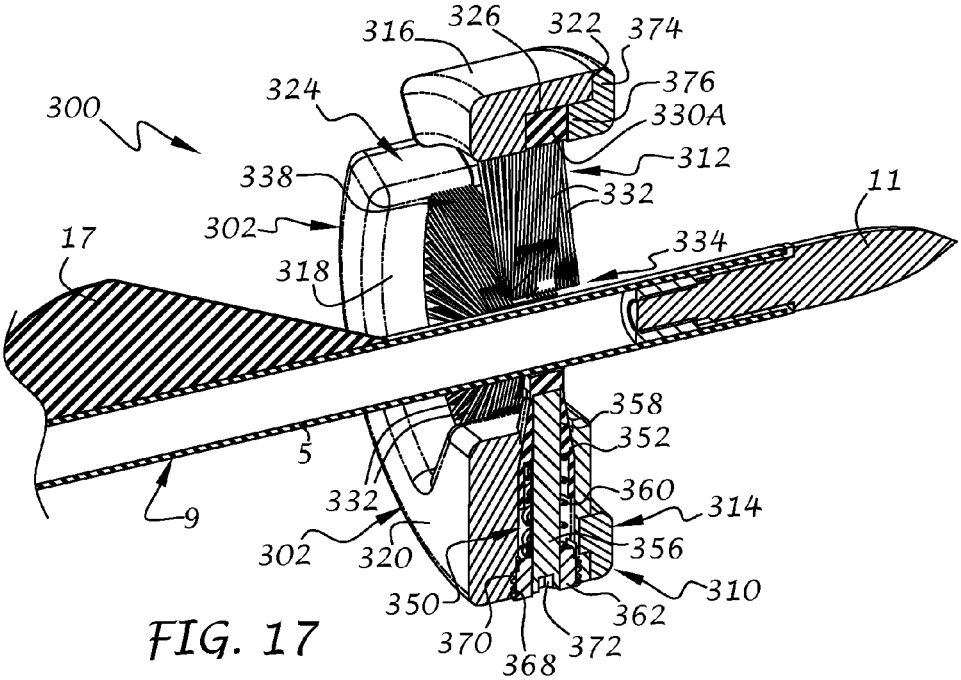
FIG. 17 is an isometric sectional view thereof taken along line 17-17 of FIG. 15.
Figure 18:
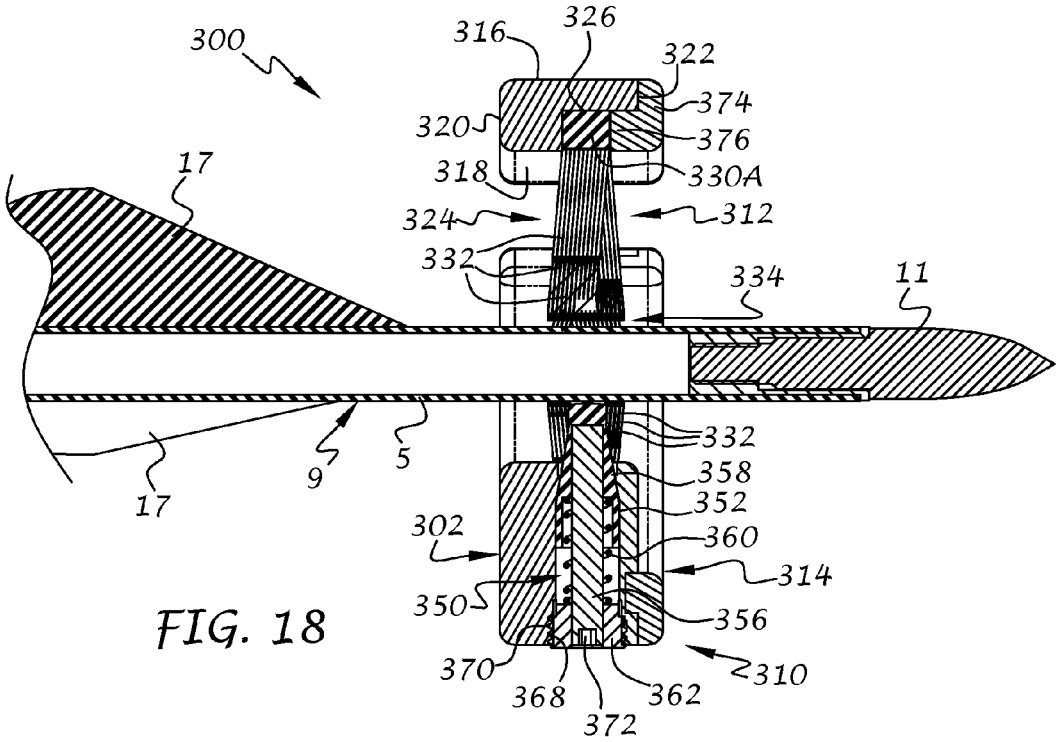
FIG. 18 is an elevational sectional view thereof taken along line 17-17 of FIG. 15.
Figure 19:
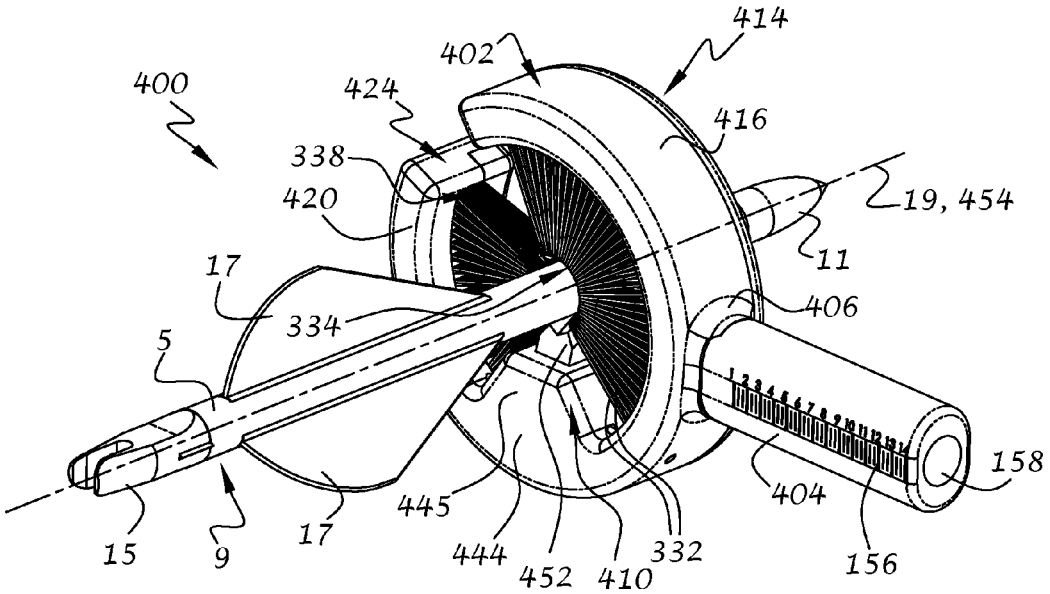
FIG. 19 is a rear isometric view of a resilient arrow rest assembly with an attached arrow in accordance with another embodiment of the invention.
Figure 20:
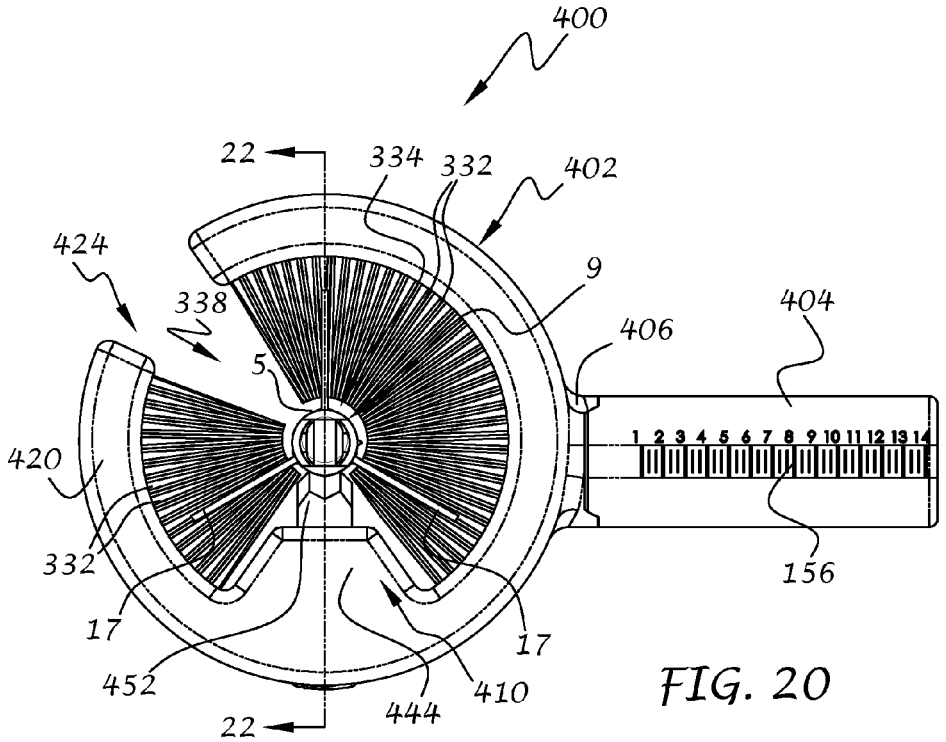
FIG. 20 is a rear elevational view thereof.

As best shown in FIGS. 16-18, the second resilient support assembly 312 of the arrow rest assembly 300 is similar to the assembly 92 previously described and includes a second annular support frame 330 similar to the support frame 196A with a first frame segment 330A and a second frame segment 330B received within the annular groove 326 of the first annular support frame 302. A plurality of second resilient support members 332, similar to the second resilient support members 195 previously described, extend radially inwardly from the first and second frame segments 330A, 330B to form a central opening 334 for receiving and retaining an arrow shaft.

As best shown in FIG. 16, a first wedge-shaped gap 336 is formed between the frame segments 330A, 330B and a corresponding aligned wedge-shaped gap 338 is formed with the support members 332. The gaps 336 and 338 are sized to receive and capture the arrow shaft in a generally radial direction, as previously described. A second wedge-shaped gap 340 is also formed between the frame segments 330A, 330B and a corresponding aligned wedge-shaped gap 342 is formed with the support members 332 to accommodate a support base 344 that forms part of the first annular support frame 302 and the second resilient support assembly 312.

The second annular support frame 330 comprises disk-shaped body segments 330A and 330B that are located in the annular groove 326 of the first annular support frame 302, and are retained therein by the third annular support frame 314.

Referring again to FIGS. 16-18, the first resilient support assembly 310 preferably includes a support base 344 that extends upwardly from the inner curved surface 318 and is centered between the rear wall 320 and front wall 322 of the first annular support frame 302. The support base 344 can be formed integrally with the first annular support frame and includes a rear wall 346 that is flush with the rear wall 320 and a front wall 348 that is flush with the front wall 322. However, it will be understood that the support base 344 can be located at any suitable position with respect to the annular support frame.

A cavity 350 is formed in the support base 344 and is sized to receive a first resilient support member or post 352 that supports the shaft 5 of an arrow 9. The first resilient support member 352 extends radially upwardly from the base 344 toward the central axis 354 of the support frame 302 so that the longitudinal centerline of an arrow shaft 5 can be coincident with the central axis 354 when positioned in the arrow rest assembly. A guide rod 356 is slidably received in a bore 358 of the first resilient support member 352. A biasing member, comprising a compression spring 360, is positioned around the guide rod 356 and an adjustment member 362 receives the guide rod 356, preferably in a press-fit installation so that the guide rod and adjustment member 362 are fixed together. It will be understood that the guide rod 356 can be secured to the adjustment member 362 through any well-known connection means or may be integrally formed therewith.

The spring 360 normally presses against the adjustment member 362 and the resilient support member 352 to bias the resilient support member upwardly. Sufficient gaps between the spring coils are provided to allow the support member to travel downwardly against the biasing forces of the spring when opposing forces are applied, such as when the arrow 9 is first shot from an archery bow, causing temporary deformation in the arrow shaft due to high acceleration forces applied to the arrow. In this manner, arrow flexure during shooting can be accommodated to thereby improve accuracy and consistency from shot to shot. An upper support surface 366 of the first resilient support member 352 is formed with a channel or groove for receiving the arrow shaft 5 to help center the arrow shaft on the first support member 352 during aiming and shooting.

The complementary shapes of the first resilient support member 352 and cavity 350 ensure that the first resilient support member 352 will be fixed against rotational movement about a vertical axis or the like with respect to the support base 344. To that end, the support member 352 and the cavity 350 can be constructed of any shape that prevents rotational movement of the resilient support member within the cavity.

The adjustment member 362 has an outer threaded surface 368 that meshes with an inner threaded surface 370 of the cavity 350. A slot 372 is formed in the bottom of the adjustment member 362 and is engageable by a screwdriver or other tool to rotate the adjustment member in a clockwise or counterclockwise direction to thereby adjust the height of the first resilient support member 352 to accommodate different arrow shaft diameters. Ideally, the geometric central axis 354 of the annular support frame 302 should be coincident with the central axis of the arrow shaft 9, which is made possible by the adjustability of the first resilient support member 352 in accordance with the invention.

The third annular support frame 314 has a front wall 374 and a generally circular protrusion 376 that extends rearwardly from the front wall. The protrusion 376 is received in the annular groove 326 of the first annular support frame 302 for axially aligning the third annular support frame 314 with the first annular support frame 302 and the second annular support frame 330. Apertures 378 are formed in the front wall for receiving fasteners 380 that thread into or are otherwise fixed with the first annular support frame 302 to thereby secure the support frames together with the second support frame 330 of the second resilient support assembly 312 sandwiched between the first and third support frames. A wedge-shaped gap 382 is formed in the third annular support frame 314 and is in alignment with the wedge-shaped gaps 336 and 324 previously described, in order to receive and capture the arrow shaft in a generally radial direction.

Referring now to FIGS. 19-23, a resilient arrow rest assembly 400 in accordance with a further embodiment of the invention is illustrated. The resilient arrow rest assembly 400 is somewhat similar in construction to the resilient arrow rest assembly 300 previously described, and has a first annular support frame 402 configured as a partially open structure for receiving an arrow 9 radially into the arrow rest assembly, as previously described. As in the previous embodiments, the arrow rest assembly 400 is intended to be connected to the riser of a bow or the like (not shown) and therefore can be provided with a windage arm 404 or other mounting structure connected to the first annular support frame 402 via a mounting protrusion 406 (FIG. 21) or other arrangement as previously described, for connection to a mounting bracket (such as mounting bracket 112 in FIG. 3) via a fastener 408 which is in turn connected to the riser of an archery bow (not shown).

The resilient arrow rest assembly 400 further includes a first resilient support assembly 410 operably associated with the first annular support frame 402 for supporting the shaft 5 of an arrow 9, and a second resilient support or guide assembly 312 positioned between the first annular support frame 402 and a third annular support frame 414 for capturing and supporting the arrow shaft 5 within the arrow rest assembly 400. The second resilient support assembly 312 is similar in construction to the support assembly 312 previously described. As in the previous embodiment, the first resilient support assembly 410 is positioned centrally or coincident with the second resilient support assembly 312.

The first annular support frame 402 has an outer curved surface 416 and an inner curved surface 418 with a rear surface 420 and a spaced front surface 422 extending between the outer and inner curved surfaces. A wedge-shaped gap or opening 424 is formed in the first annular support frame 402 between the outer and inner curved surfaces for receiving the shaft 5 of an arrow in a generally radial direction during loading and unloading (as shown in FIG. 3 for example). An annular groove 426 is formed in the inner curved surface 418 and extends rearwardly from the front surface 422 of the first annular support frame 402 for receiving the second resilient support assembly 312. As in the previous embodiments, the second annular support frame 330 comprises disk-shaped body segments 330A, 330B (FIG. 21) that fit into the annular groove 426 of the first annular support frame 402, and are retained therein by the third annular support frame 414.

Figure 21:
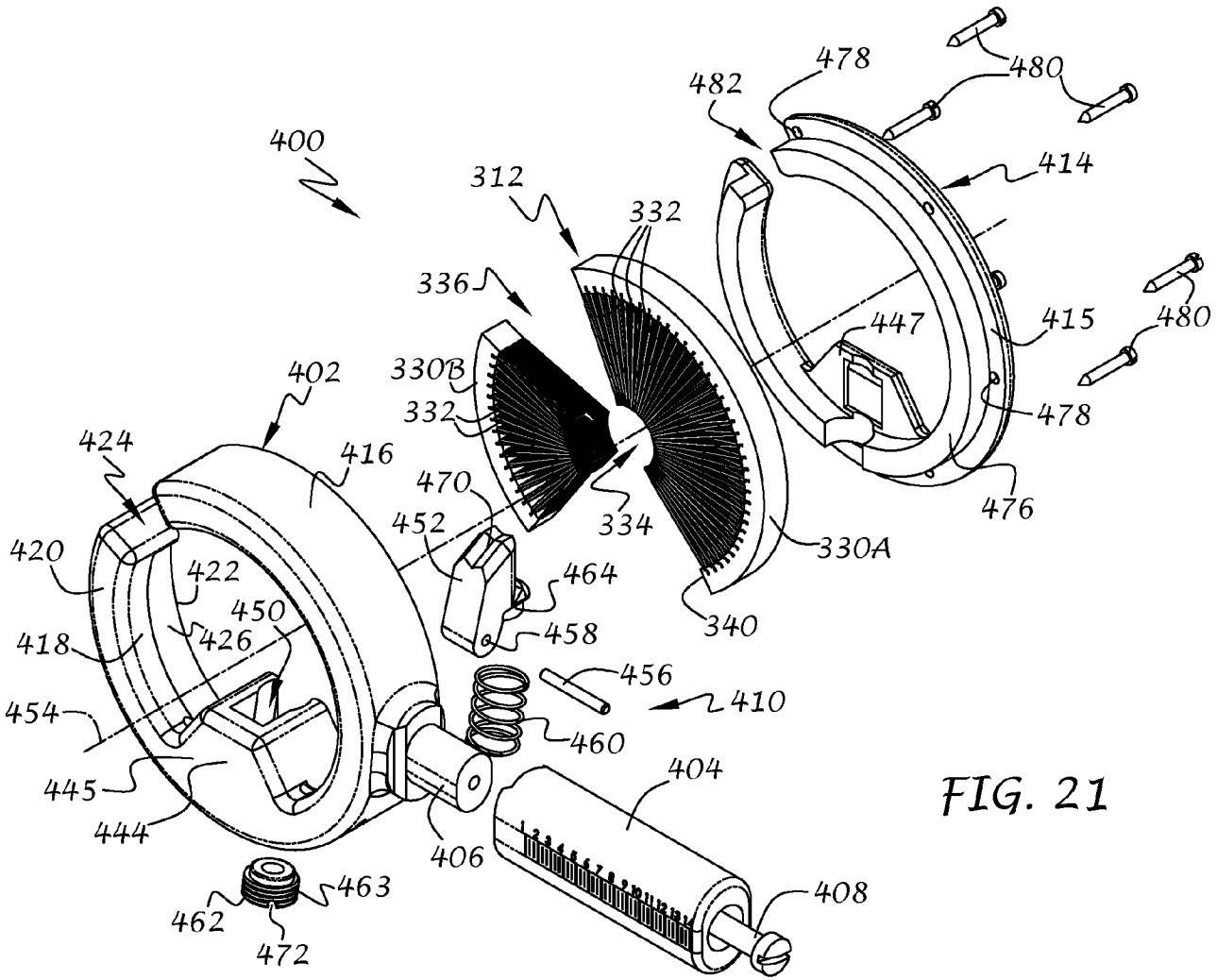
FIG. 21 is a rear isometric exploded view thereof.
Figure 22:
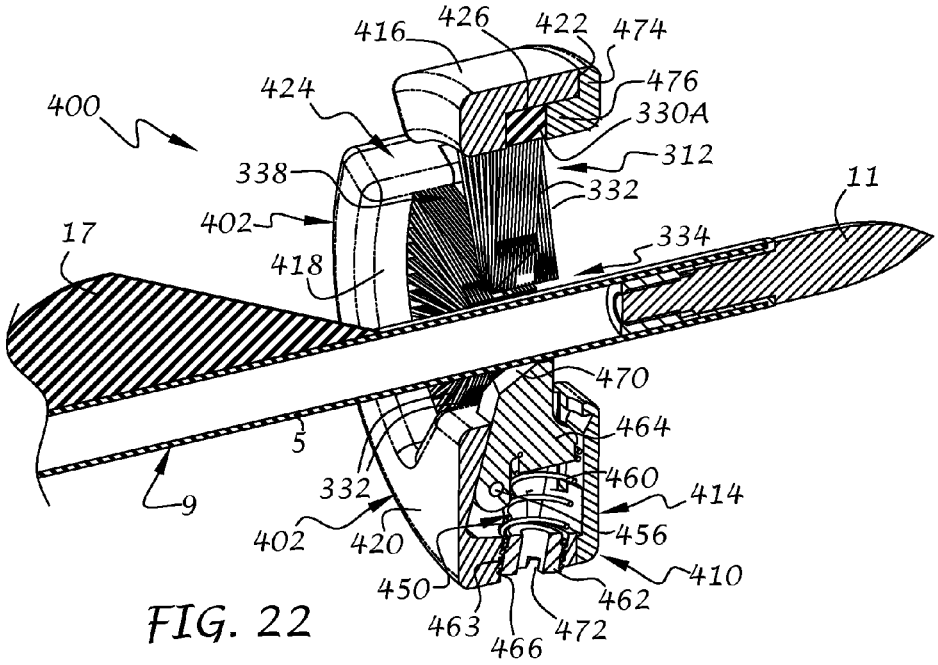
FIG. 22 is an isometric sectional view thereof taken along line 22-22 of FIG. 20.
Figure 23:
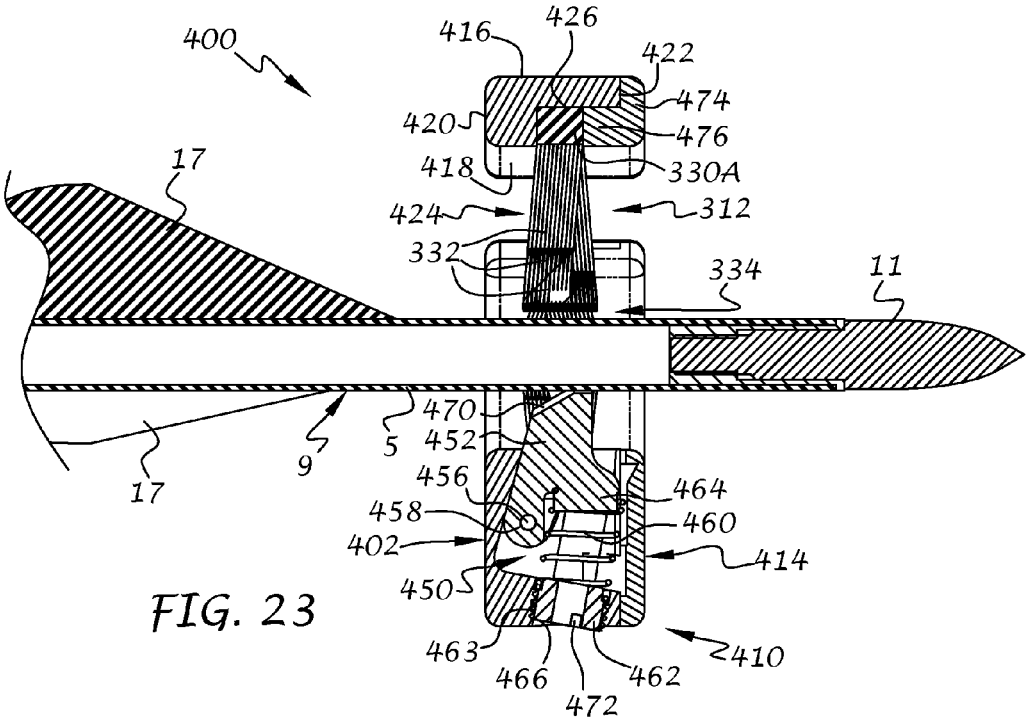
FIG. 23 is an elevational sectional view thereof taken along line 22-22 of FIG. 20.
Figure 24:
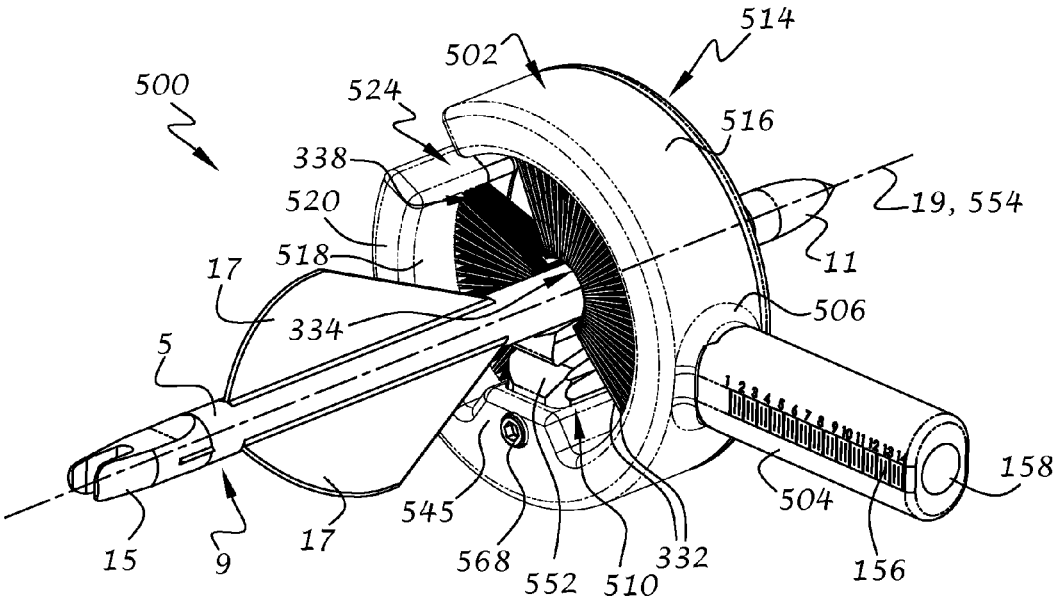
FIG. 24 is a rear isometric view of a resilient arrow rest assembly with an attached arrow in accordance with yet another embodiment of the invention.
Figure 25:
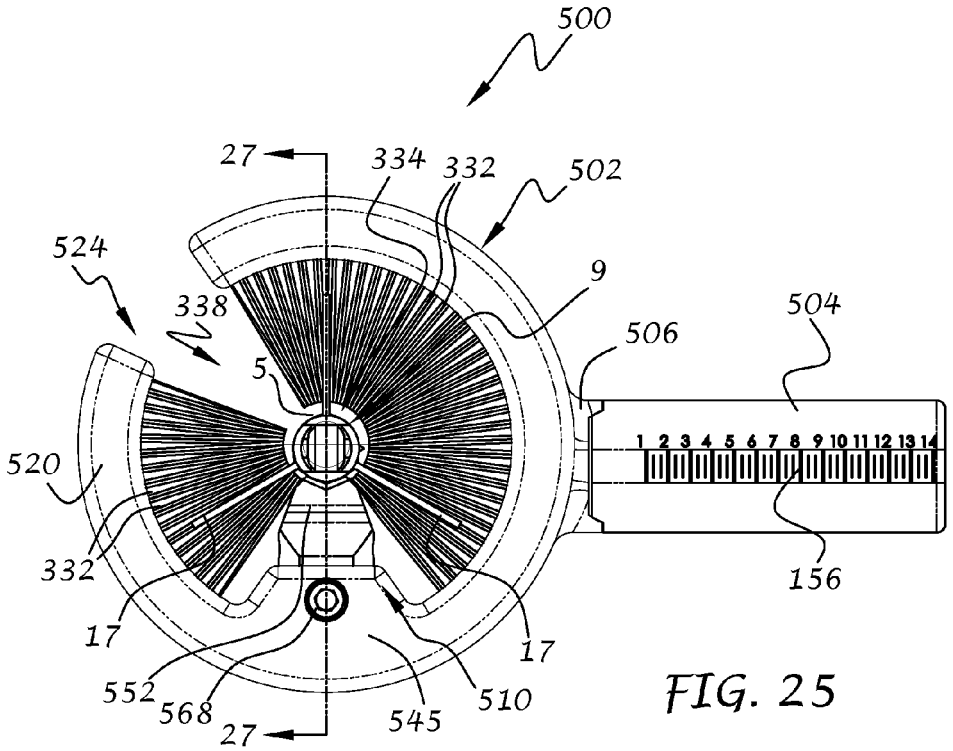
FIG. 25 is a rear elevational view thereof.

Referring to FIGS. 21-23, the first resilient support assembly 410 preferably includes a support base 444 with a first base segment 445 that extends upwardly from the inner curved surface 418 and extends between the rear surface 420 of the first support frame 402 and the front surface 422 thereof, and a second base segment 447 that extends upwardly from the front surface or wall 415 of the third support frame 414. The first base segment 445 is integrally formed with the first annular support frame and the second base segment 447 is integrally formed with the third annular support frame 414. However, it will be understood that the support base 344 can be located at any suitable position with respect to the annular support frames.

When the first and third annular support frames are connected together, a cavity 450 is formed in the support base 444 between the first base segment 445 and the second base segment 447. The cavity 450 is sized to receive a first resilient support member or post 452 that in turn supports the shaft 5 of an arrow 9. The first resilient support member 452 extends upwardly from the base 444 toward the central axis 454 of the support frame 402 so that the longitudinal centerline of an arrow shaft 5 can be coincident with the central axis 454 when positioned in the arrow rest assembly.

A pivot rod 456 is mounted in the cavity 450 and extends through a bore 458 formed in the first resilient support member 452 to allow pivoting movement of the first resilient support member about the pivot rod 456 and with respect to the first annular support frame 402. A spring seat 464 is formed in the first resilient support member 452 forward of the bore 458. An adjustment member 462 with an outer threaded surface 463 is positioned in a threaded bore 466 formed in the first support frame 402 at a location that intersects the cavity 450.

A compression spring 460 extends between the spring seat 464 and the adjustment member 462 to bias the resilient support member upwardly about the pivot rod 456. Gaps between the spring coils are provided to allow the support member 452 to pivot downwardly against the biasing force of the spring 460 when opposing forces are applied, such as when the arrow 9 is first shot from an archery bow, causing temporary deformation in the arrow shaft due to high acceleration forces applied to the arrow, as previously described. In this manner, arrow flexure during shooting can be accommodated to thereby improve accuracy and consistency from shot to shot. An upper support surface 470 (FIG. 21) of the first resilient support member 452 can include a V-shaped channel or groove for receiving the arrow shaft 5 to help center the arrow shaft on the first support member 452 during aiming and shooting.

A slot 472 is formed in the bottom of the adjustment member 462 and is engageable by a screwdriver or other tool to rotate the adjustment member in a clockwise or counterclockwise direction to thereby adjust the height of the first resilient support member 452 to accommodate different arrow shaft diameters. Ideally, the central axis 454 of the first annular support frame 402 should be coincident with the central axis of the arrow shaft 9, which is made possible by the adjustability of the first resilient support member 452 in accordance with the invention.

The third annular support frame 414 has a front wall 415 and a generally circular protrusion 476 that extends rearwardly from the front wall. The protrusion 476 is received in the annular groove 426 of the first annular support frame 402 for axially aligning the third annular support frame 414 with the first annular support frame 402 and the second annular support frame 330. Apertures 478 are formed in the front wall for receiving fasteners 480 that thread into or are otherwise fixed with the first annular support frame 402 to thereby secure the support frames together with the second support frame 330 of the second resilient support assembly 312 sandwiched between the first and third support frames. A wedge-shaped gap 482 is formed in the third annular support frame 414 and is in alignment with the wedge-shaped gaps 336 and 424 in order to receive and capture the arrow shaft in a generally radial direction, as previously described.

With reference now to FIGS. 24 to 28, a resilient arrow rest assembly 500 in accordance with a further embodiment of the invention is illustrated. The resilient arrow rest assembly 500 is somewhat similar in construction to the resilient arrow rest assembly 220 previously described, and has a first annular support frame 502 configured as a partially open structure for receiving an arrow 9 radially into the arrow rest assembly, as previously described. As in the previous embodiments, the arrow rest assembly 500 is intended to be connected to the riser of a bow or the like (not shown) and therefore can be provided with a windage arm 504 or other mounting structure connected to the first annular support frame 502 via a mounting protrusion 506 or other structure as previously described, for connection to a mounting bracket (such as mounting bracket 112 in FIG. 3) which is in turn connected to the riser of an archery bow (not shown).

The resilient arrow rest assembly 500 further includes a first resilient support assembly 510 operably associated with the first annular support frame 502 for supporting the shaft 5 of an arrow 9, and a second resilient support or guide assembly 312 positioned between the first annular support frame 502 and a third annular support frame 514 for capturing and supporting the arrow shaft 5 within the arrow rest assembly 500. The second resilient support assembly 312 is similar in construction to the support assembly 312 previously described. As in the previous embodiment, the first resilient support assembly 510 is positioned coincident with the second resilient support assembly 312.

The first annular support frame 502 has an outer curved surface 516 and an inner curved surface 518 with a rear surface 520 and a spaced front surface 522 extending between the outer and inner curved surfaces. A wedge-shaped gap or opening 524 is formed in the first annular support frame 502 between the outer and inner curved surfaces for receiving the shaft 5 of an arrow in a generally radial direction during loading and unloading (as shown in FIG. 3 for example). An annular groove 526 is formed in the inner curved surface 518 and extends rearwardly from the front surface 522 of the first annular support frame 502 for receiving the second resilient support assembly 312 and the third annular support frame 514. As in the previous embodiments, the second annular support frame 330 is configured as disk-shaped body segments 330A, 330B (FIG. 21) that fit into the annular groove 526 of the first annular support frame 502, and are retained therein by the third annular support frame 514.

Figure 26:
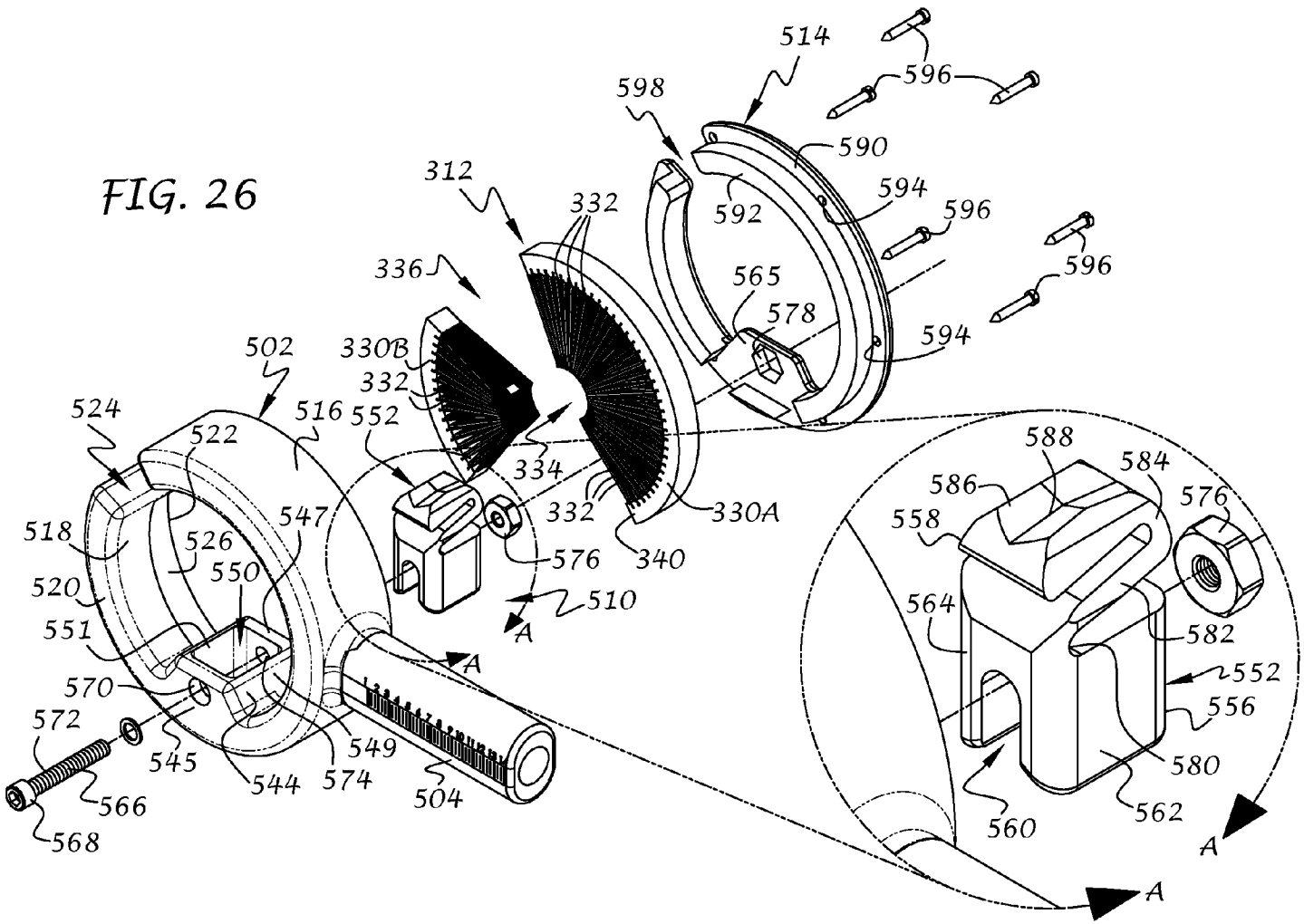
FIG. 26 is a rear isometric exploded view thereof, with an enlarged view of a resilient arrow support member as shown in circle A-A.
Figure 27:
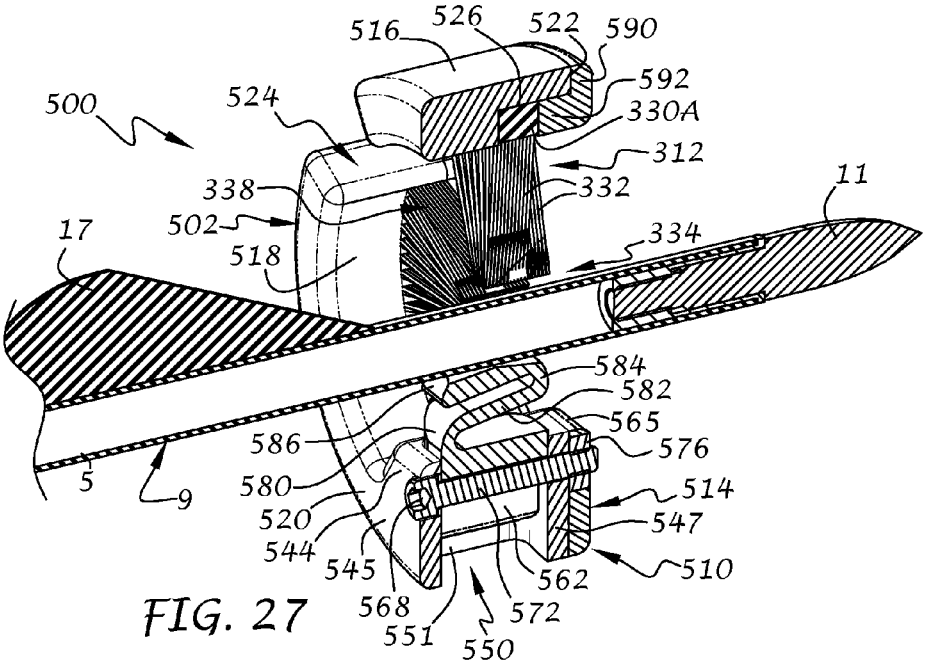
FIG. 27 is an isometric sectional view thereof taken along line 27-27 of FIG. 25.
Figure 28:
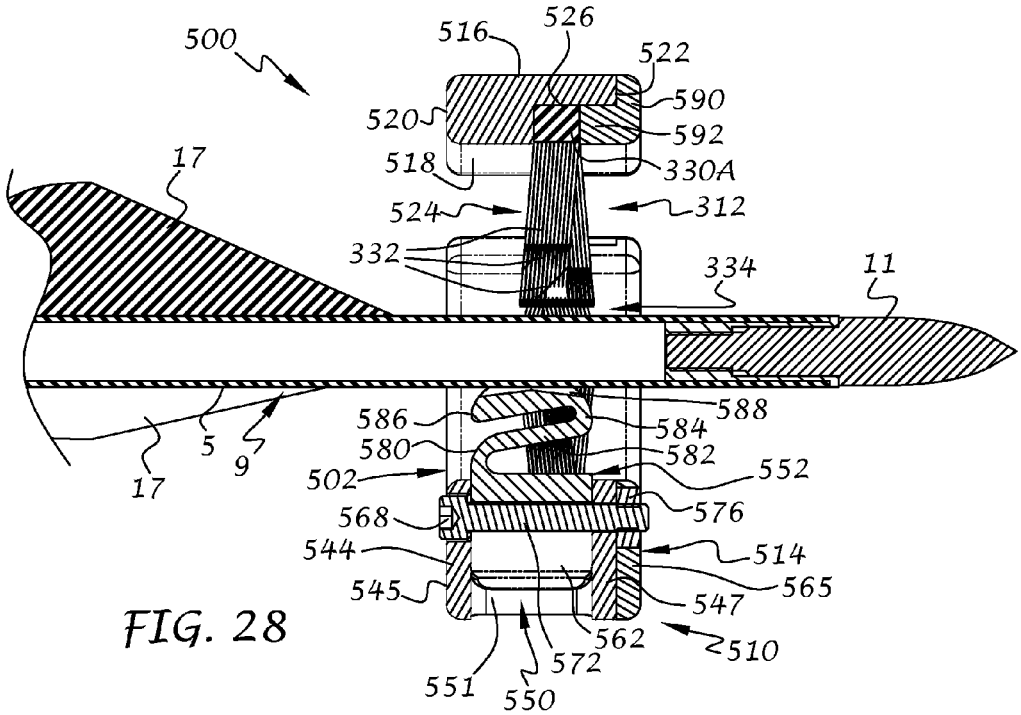
FIG. 28 is an elevational sectional view thereof taken along line 27-27 of FIG. 25.

Referring to FIGS. 26-28, the first resilient support assembly 510 preferably includes a first support base section 544 with a rear wall 545 and a front wall 547, and side walls 549, 551 extending therebetween. The walls extend upwardly from the inner curved surface 518 and form a cavity 550. The support base 544 is integrally formed with the first annular support frame 502.

The cavity 550 is sized to receive a first resilient support member or post 552 that in turn supports the shaft 5 of an arrow 9. The first resilient support member 552 extends upwardly from the base 544 toward the central axis 554 of the support frame 502 so that the longitudinal centerline of an arrow shaft 5 can be coincident with the central axis 554 when positioned in the arrow rest assembly.

The first resilient support member 552 preferably includes a first connecting section or mounting section 556 removably connected to the first support base section 544 of the first support frame 502 and a resilient arrow rest section 558 extending upward from the mounting section 556 for supporting the shaft 5 of an arrow 9. The mounting section 556 is shown as generally square-shaped or rectangular-shaped in cross section and fits into the cavity 550, which is complementary in shape to the mounting section 556. The complementary shapes of the mounting section 556 and cavity 550 ensure that the resilient support member 552 will be fixed against rotational movement about an axis transverse to the axis 554. It will be understood that the mounting section 556 and cavity 550 can be constructed of any shape that prevents rotational movement of the resilient support member within the cavity 550.

A slot 560 extends through the mounting section 556 to form a first mounting leg 562 and a second mounting leg 564. A fastener 566, such as a threaded bolt, has a head portion 568 located in a rear opening 570 (FIG. 26) formed in the rear wall 545 of the first support base section 544 and a shaft portion 572 that extends from the head portion 568 and through slot 560 of the mounting section 556 and a front opening 574 formed in the front wall 547 of the first support base section 544. A threaded nut 576 or the like is located in a complementary-shaped opening 578 formed in a second support base section 565 of the third annular support frame 514. The second support base section 565, as best shown in FIG. 26, is similar in shape to the first support base section 544 of the first annular support frame 502.

In order to adjust the height of the first resilient support member 552, the fastener 566 is loosened, and the mounting section 556 of the first resilient support member is slid upwardly or downwardly in the cavity 550 with respect to the fastener 566 until the desired height is achieved for the resilient arrow rest section 558. Subsequently, the nut 576 and fastener 566 are tightened to thereby sandwich the mounting section 556 within the support base section 544 in a fixed manner.

A first integral hinge section 580 is formed or otherwise located between the mounting section 556 and the resilient arrow rest section 558. A first lever arm 582 extends between the first integral hinge section 580 and a second integral hinge section 584. A second lever arm 586 extends from the second integral hinge section 584 and serves as the support section for receiving the shaft 5 of an arrow 9. The first and second integral hinges together with the first and second lever arms form a generally S-shaped resilient arrow rest section 558. The hinge sections 580, 584 are relatively thin in cross section so that the second lever arm 586 deflects when a force is applied thereto, such as when an arrow is being shot from an archery bow to accommodate temporary deformation of the arrow shaft. In this manner, the archer can be confident that the arrow will travel towards its intended target rather than being deflected by the arrow rest, as in prior art rigid arrow rests. The hinge sections are also thick enough to reduce the effects of work hardening that might otherwise occur with thinner hinges over the life of the first resilient support member 552. A generally V-shaped groove 588 is formed in the second lever arm 586 along the length thereof for receiving the arrow shaft 5.

As in the previous embodiments, the first resilient support member can be made out of any suitable material such as plastics, composites, metal, or other materials or combinations thereof, to minimize noise during arrow drawback and launch while reducing the effects of work hardening. Although not shown in this embodiment, a wear insert 286 (FIG. 11) in the form of a cylindrical metal pin or other suitable material and shape, can be located in the second lever arm 586 below the V-shaped groove 588 to serve as a wear indicator to alert the user that the first support member should be replaced. The harder surface of the insert also functions as a safety feature by permitting an archer to continue shooting even with the V-shaped groove substantially worn away. Depending on the selected material for the wear insert, a sound may be generated as the arrow shaft passes over the insert to further alert the operator that the support member should be replaced.

As in the previous embodiments, the combination of the first resilient support member 552 and the second resilient support members 332 facilitate guidance of the arrow shaft toward the central opening 334 of the arrow rest and then flex back to their original state when the arrow shaft is positioned on the first resilient support member 552 to thereby capture the arrow.

As best shown in FIG. 26, the third annular support frame 514 has a front wall 590 with which the second support base section 565 is integrally formed, and a generally circular protrusion 592 that extends rearwardly from the front wall. The protrusion 592 is received in the annular groove 526 of the first annular support frame 502 for axially aligning the third annular support frame 514 with the first annular support frame 502 and the second annular support frame 330, as previously described. Apertures 594 are formed in the front wall 590 for receiving fasteners 596 that thread into or are otherwise fixed with the first annular support frame 502 to thereby secure the support frames together with the second support frame 330 of the second resilient support assembly 312 sandwiched between the first and third support frames. A wedge-shaped gap 598 is formed in the third annular support frame 514 and is in alignment with the wedge-shaped gaps 336 and 524 in order to receive and capture the arrow shaft in a generally radial direction, as previously described.

In accordance with a further embodiment of the invention, the second resilient support assembly is not limited to resilient brush-type guide members but can be constructed with a wide variety of different configurations, materials, sizes, flexibility, and so on. For example, the present invention can include the adjustable arrow rest support in combination with virtually any suitable arrow rest structure where the shaft of an arrow can be captured and the fletchings can pass through radially extending support or guide members. Suitable support structures for capturing an arrow shaft are disclosed for example in U.S. Pat. No. 9,243,862 issued on Jan. 26, 2016 to the same assignee of the present application, the disclosure of which is hereby incorporated by reference in its entirety. In this manner, the present invention is capable of aligning the shaft of an arrow with the axial center of the arrow rest and/or related support structure to ensure consistency and accuracy from shot to shot while preventing the inadvertent release of the arrow shaft from the arrow rest during various activities as previously described.

It will be understood that the term "preferably" as used throughout the specification refers to one or more exemplary embodiments of the invention and therefore is not to be interpreted in any limiting sense. In addition, terms of orientation and/or position as may be used throughout the specification denote relative, rather than absolute orientations and/or positions.

It will be appreciated by those skilled in the art that changes could be made to the embodiments described above without departing from the broad inventive concept thereof. It will be understood, therefore, that the present invention is not limited to the particular embodiments disclosed, but also covers modifications within the spirit and scope of the invention as defined by the appended claims.

What is claimed is:

1. An arrow rest assembly for connection to an archery bow and for supporting and capturing an arrow having an arrow shaft and vanes extending therefrom, the arrow rest assembly comprising:

at least one support frame defining a space for receiving an arrow shaft;

a post extending into the space for supporting the arrow shaft;

a plurality of support members connected to the at least one support frame and extending into the space, the plurality of support members being arranged to surround the arrow shaft sufficiently to define an opening having a predetermined size larger than the arrow shaft for capturing the arrow shaft therein and directing movement of the arrow shaft towards the post; and the plurality of support members being spaced from the arrow shaft when the arrow shaft is supported by the post;

wherein the support members are arranged with respect to the at least one support frame such that at least one of the vanes of the arrow is adapted to pass through adjacent support members when the arrow is launched from the archery bow.

2. An arrow rest assembly according to claim 1, wherein the post is adjustable to adjust an axis of the arrow shaft with respect to the opening defined by the plurality of support members.

3. An arrow rest assembly according to claim 1, wherein the plurality of support members are positioned forwardly of the post.

4. An arrow rest assembly according to claim 1, wherein the plurality of support members are positioned rearwardly of the post.

5. An arrow rest assembly according to claim 1, wherein the plurality of support members are in alignment with the post.

6. An arrow rest assembly according to claim 1, and further comprising:

the at least one support frame including a first support frame having a first axis;

a first support assembly having the post extending from the first support frame towards the first axis, the post being adjustable toward and away from the first axis such that a second axis associated with the arrow shaft can be adjusted with respect thereto; and the at least one support frame including a second support frame connected to the first support frame, with the plurality of support members extending from the second support frame to form the opening for capturing the arrow shaft;

the first and second support frames being connected together;

wherein the second support members are spaced from the arrow shaft when the arrow shaft is supported by the first support member.

7. An arrow rest assembly according to claim 6, wherein the plurality of support members are located circumferentially around the second support frame and extend radially therefrom toward the first axis to define the opening.

8. An arrow rest assembly according to claim 6, wherein the first support assembly further comprises a support base extending upwardly from the first support frame and having a cavity formed therein for receiving the post.

9. An arrow rest assembly according to claim 8, wherein the post comprises:

a connecting section connected to the support base for movement with respect thereto; and an arrow rest section extending upwardly from the connecting section and having an upper support surface for supporting the arrow shaft;

wherein movement of the connecting section causes the upper support surface to move toward or away from the first axis to thereby adjust a position of the second axis associated with the arrow shaft relative to the first axis.

10. An arrow rest assembly according to claim 9, wherein the connecting section is slidable within the cavity in a linear direction toward and away from the first axis.

11. An arrow rest assembly according to claim 10, wherein the first support assembly further comprises a biasing member positioned within the cavity and contacting the connecting section for biasing the post toward the first axis to thereby cause the post to exhibit resiliency toward and away from the first axis.

12. An arrow rest assembly according to claim 11, wherein the first support assembly further comprises an adjustment member connected to the support base and operably associated with the biasing member, the adjustment member being selectively stationary during operation with respect to the support base and being movable during calibration toward and away from the first axis to thereby move the biasing member, and thus the upper support surface of the post, toward and away from the first axis for adjusting the position of the second axis relative to the first axis.

13. An arrow rest assembly according to claim 12, wherein the biasing member comprises a compression spring positioned between the post and the adjustment member within the cavity, such that the post moves away from the first axis against biasing forces from the compression spring to thereby accommodate temporary deformation of the arrow shaft as it travels through the first support frame during shooting.

14. An arrow rest assembly according to claim 9, wherein the connecting section is pivotally connected to the first support frame to pivot the upper support surface toward and away from the first axis.

15. An arrow rest assembly according to claim 14, wherein the first support assembly further comprises a biasing member positioned within the cavity and contacting the connecting section for pivotally biasing the post toward the first axis to thereby cause the first support member to exhibit resiliency toward and away from the first axis.

16. An arrow rest assembly according to claim 15, wherein the first support assembly further comprises an adjustment member connected to the support base and operably associated with the biasing member, the adjustment member being selectively stationary during operation with respect to the support base and being movable during calibration to thereby pivot the biasing member, and thus the upper support surface of the post, toward and away from the first axis for adjusting the position of the second axis relative to the first axis.

17. An arrow rest assembly according to claim 16, wherein the biasing member comprises a compression spring positioned between the post and the adjustment member within the cavity, such that the post pivots away from the first axis against biasing forces from the compression spring to thereby accommodate temporary deformation of the arrow shaft as it travels through the first support frame during shooting.

18. An arrow rest assembly according to claim 9, wherein the post further comprises a first integral hinge section located between the connecting section and the arrow rest section for biasing the arrow rest section toward the first axis to thereby cause the post to exhibit resiliency toward and away from the first axis.

19. An arrow rest assembly according to claim 18, wherein the post further comprises:

a first lever arm extending from the first integral hinge section;

a second integral hinge section located at an opposite end of the first lever arm; and a second lever arm extending from the second integral hinge section, the second lever arm comprising the upper support surface for supporting the arrow shaft;

wherein the first and second integral hinges together with the first and second lever arms form a generally S-shaped resilient arrow rest section that deflects when a force is applied thereto to accommodate temporary deformation of the arrow shaft during shooting.

20. An arrow rest assembly according to claim 9, wherein the first support assembly further comprises:

a slot extending through the connecting section to form a first mounting leg and a second mounting leg; and a fastener connected to the support base and extending through the slot for releasably securing the first support assembly to the support base;

wherein the upper support surface of the first support member is linearly moveable toward and away from the first axis with the fastener loosened to thereby adjust the position of the second axis relative to the first axis; and wherein the connecting section is secured against movement within the support base when the fastener is tightened.

21. An arrow rest assembly according to claim 6, wherein the at least one support frame further comprises a third support frame connected to the first support frame for securing the second support frame therebetween.

22. An arrow rest assembly according to claim 21, wherein the first, second, and third support frames are circular in shape and include aligned wedge-shaped gaps for receiving the arrow shaft into the opening in a general radial direction.

23. An arrow rest assembly according to claim 1, wherein the plurality of support members are located circumferentially around the at least one support frame and extend radially therefrom toward the first axis to define the opening and capture the arrow shaft therein.

* * * * *